US010207418B2

(12) United States Patent
McGuffin-Noll et al.

(10) Patent No.: US 10,207,418 B2
(45) Date of Patent: Feb. 19, 2019

(54) PRODUCT SLICER AND AUTOMATIC SLICER ENGAGEMENT MECHANISM

(71) Applicant: GLOBE FOOD EQUIPMENT COMPANY, Dayton, OH (US)

(72) Inventors: Douglas J. McGuffin-Noll, Westerville, OH (US); Peter Dierauer, Jamestown, OH (US)

(73) Assignee: Globe Food Equipment Company, Dayton, OH (US)

( * ) Notice: Subject to any disclaimer, the term of this patent is extended or adjusted under 35 U.S.C. 154(b) by 155 days.

(21) Appl. No.: 15/265,105

(22) Filed: Sep. 14, 2016

(65) Prior Publication Data

US 2018/0071937 A1 Mar. 15, 2018

(51) Int. Cl.

| | |
|---|---|
| ***B26D 7/06*** | (2006.01) |
| ***B26D 5/20*** | (2006.01) |
| ***B26D 5/22*** | (2006.01) |
| ***B26D 3/28*** | (2006.01) |
| ***B26D 7/01*** | (2006.01) |
| *B26D 1/12* | (2006.01) |

(52) U.S. Cl.

CPC ..... *B26D 5/22* (2013.01); *B26D 3/28* (2013.01); *B26D 7/01* (2013.01); *B26D 7/0616* (2013.01); *B26D 1/12* (2013.01); *B26D 2210/02* (2013.01)

(58) Field of Classification Search

CPC ..... B26D 5/22; B26D 1/28; B26D 7/01
USPC ..... 83/707, 713, 730, 412
See application file for complete search history.

(56) References Cited

U.S. PATENT DOCUMENTS

| | | | | |
|---|---|---|---|---|
| 1,795,931 | A | 3/1931 | Campbell | |
| 2,001,771 | A | 5/1935 | Campbell | |
| 2,341,582 | A * | 2/1944 | Turner | B26D 5/22 83/404.3 |
| 2,431,391 | A | 11/1947 | Folk | |
| 2,433,600 | A | 12/1947 | Cohen | |
| 2,598,740 | A | 6/1952 | Zimmerman | |
| 2,682,289 | A | 6/1954 | Brown | |
| 2,691,398 | A | 10/1954 | Klingens | |
| 4,546,685 | A | 10/1985 | Maurer et al. | |
| 4,813,316 | A | 3/1989 | Johnson et al. | |
| 5,224,407 | A | 7/1993 | Koch et al. | |
| 5,666,866 | A | 9/1997 | Huang et al. | |
| 5,687,626 | A | 11/1997 | Scherch et al. | |
| D390,414 | S | 2/1998 | Shirk et al. | |
| D390,748 | S | 2/1998 | Short et al. | |
| D404,611 | S | 1/1999 | Heckman | |
| 5,862,730 | A | 1/1999 | Cartwright et al. | |
| 5,970,840 | A | 10/1999 | Yan et al. | |
| D422,449 | S | 4/2000 | Johnson et al. | |
| 6,092,448 | A | 7/2000 | Cartwright et al. | |
| 6,119,566 | A | 9/2000 | Yan et al. | |
| 6,167,791 | B1 | 1/2001 | Heckman et al. | |

(Continued)

OTHER PUBLICATIONS

International Search Report and Written Opinion of the International Searching Authority for International Application No. PCT/US17/16650, dated Apr. 28 2017, eight pages.

*Primary Examiner* — Omar Flores Sanchez
(74) *Attorney, Agent, or Firm* — Brinks Gilson & Lione

(57) ABSTRACT

A product slicer incorporating an automatic slicer engagement mechanism attached to a carriage assembly and configured for quick, safe, reliable, and releasable engagement with a belt to provide powered automated slicing, and disengagement to allow manual slicing.

18 Claims, 18 Drawing Sheets

(56) References Cited

U.S. PATENT DOCUMENTS

| | | | |
|---|---|---|---|
| 6,209,438 | B1 | 4/2001 | Mitchell et al. |
| 6,261,161 | B1 | 7/2001 | Yan |
| 6,389,943 | B1 | 5/2002 | Wagner et al. |
| D463,713 | S | 10/2002 | Zhu |
| 6,709,319 | B2 | 3/2004 | Yan |
| 6,845,697 | B2 | 1/2005 | Kovacs |
| 6,935,216 | B1 | 8/2005 | Yan et al. |
| 6,998,557 | B2 | 2/2006 | McGuffin-Noll |
| 7,073,421 | B1 | 7/2006 | Verhalen et al. |
| 7,134,937 | B1 | 11/2006 | Chen et al. |
| 7,194,933 | B2 | 3/2007 | Zhu et al. |
| 7,234,382 | B2 | 6/2007 | Zhu |
| 7,257,899 | B2 | 8/2007 | Zhu et al. |
| 8,136,435 | B2 | 3/2012 | Zhu et al. |
| 8,215,219 | B2 | 7/2012 | Rummel et al. |
| 8,333,136 | B2 | 12/2012 | Rummel et al. |
| 9,272,433 | B2 | 3/2016 | Mueller |
| 2003/0079589 | A1 | 5/2003 | Kovacs |
| 2003/0079595 | A1 | 5/2003 | Shariff et al. |
| 2003/0200848 | A1 | 10/2003 | Kuchler |
| 2004/0000060 | A1 | 1/2004 | Zhu et al. |
| 2005/0000346 | A1 | 1/2005 | Hartley et al. |
| 2005/0045455 | A1 | 3/2005 | McGuffin-Noll |
| 2005/0132854 | A1 | 6/2005 | Kovacs |
| 2005/0211045 | A1 | 9/2005 | Zhu et al. |
| 2006/0150791 | A1 | 7/2006 | Chase et al. |
| 2007/0137438 | A1 | 6/2007 | Zhu et al. |
| 2007/0142959 | A1 | 6/2007 | Rummel et al. |
| 2008/0083310 | A1 | 4/2008 | Verhalen et al. |
| 2009/0133552 | A1 | 5/2009 | McGuffin-Noll |
| 2009/0173201 | A1 | 7/2009 | Zhu et al. |
| 2017/0210569 | A1* | 7/2017 | Dopp ..... B26D 5/22 |

* cited by examiner

PRODUCT SLICER AND AUTOMATIC SLICER ENGAGEMENT MECHANISM

CROSS-REFERENCE TO RELATED APPLICATIONS

Not applicable.

STATEMENT REGARDING FEDERALLY SPONSORED RESEARCH OR DEVELOPMENT

This invention was not made as part of a federally sponsored research or development project.

TECHNICAL FIELD

The present disclosure relates generally to food product slicers, more particularly, to a device, method, system, and mechanism for quickly and safely switching between manual slicing and powered automatic slicing.

BACKGROUND OF THE INVENTION

Many food product slicers operate in both manual and automatic slicing modes. The industry has long needed an inexpensive mechanism that simplifies the engagement and disengagement of the automatic slicing mode while ensuring reliable operation during the slicers expected service life.

SUMMARY OF THE INVENTION

A product slicer incorporating an automatic slicer engagement mechanism attached to a carriage assembly and configured for quick, safe, reliable, and releasable engagement with a belt to provide powered automated slicing, and disengagement to allow manual slicing. The product slicer includes a housing; a knife mounted to the housing and rotatable about a central knife axis and having a knife cutting edge; a carriage assembly mounted to the housing, the carriage assembly including a carriage table configured for reciprocating motion past the knife cutting edge; a drive system mounted to the housing and including at least one motor to drive a belt; and an automatic slicer engagement mechanism attached to the carriage assembly and configured for releasable engagement with the belt.

BRIEF DESCRIPTION OF THE DRAWINGS

Without limiting the scope of the present invention as claimed below and referring now to the drawings and figures:

Figure 1:
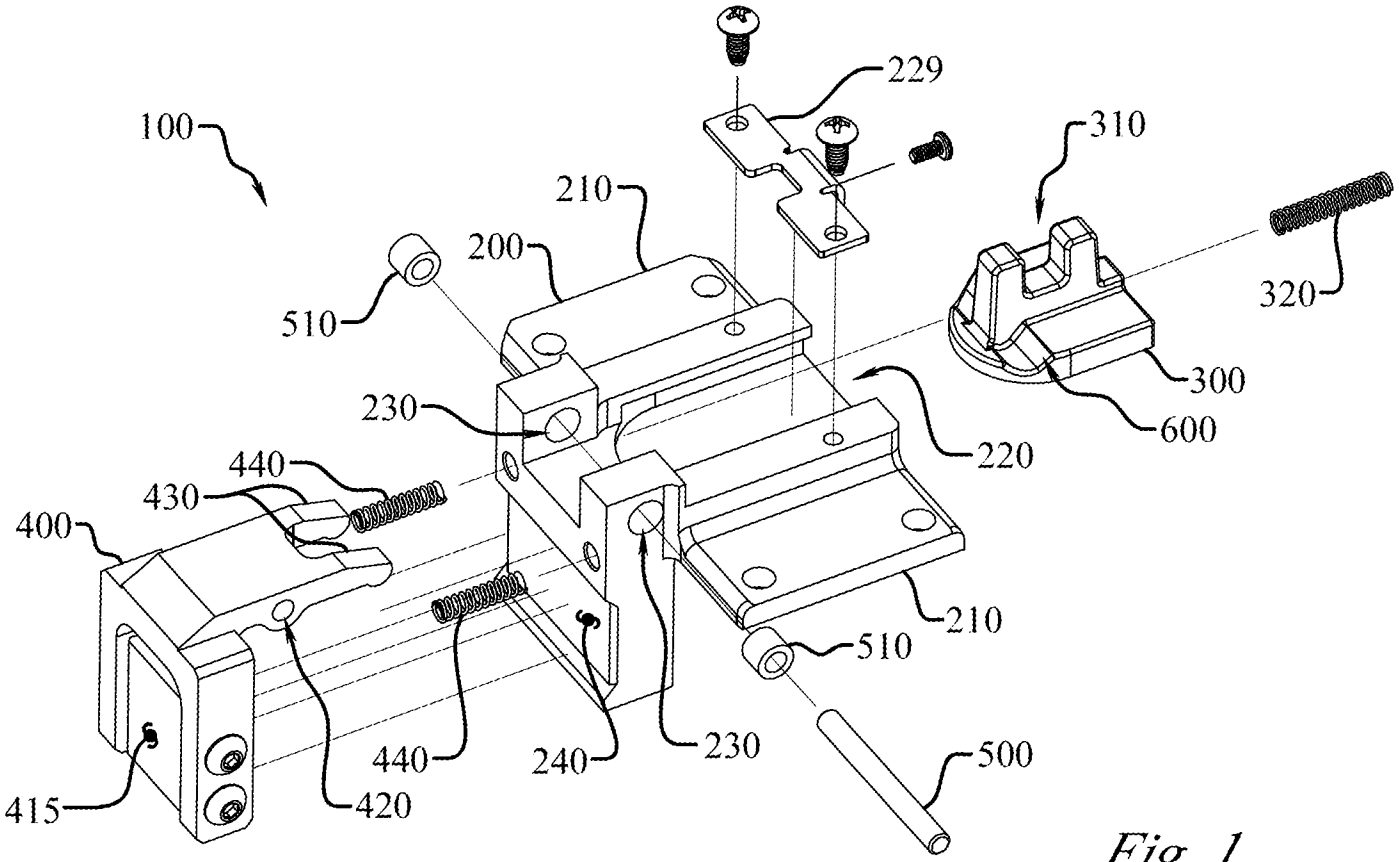
FIG. 1 shows an isometric assembly view of components of an embodiment of an automatic slicer clamp mechanism.
Figure 2:
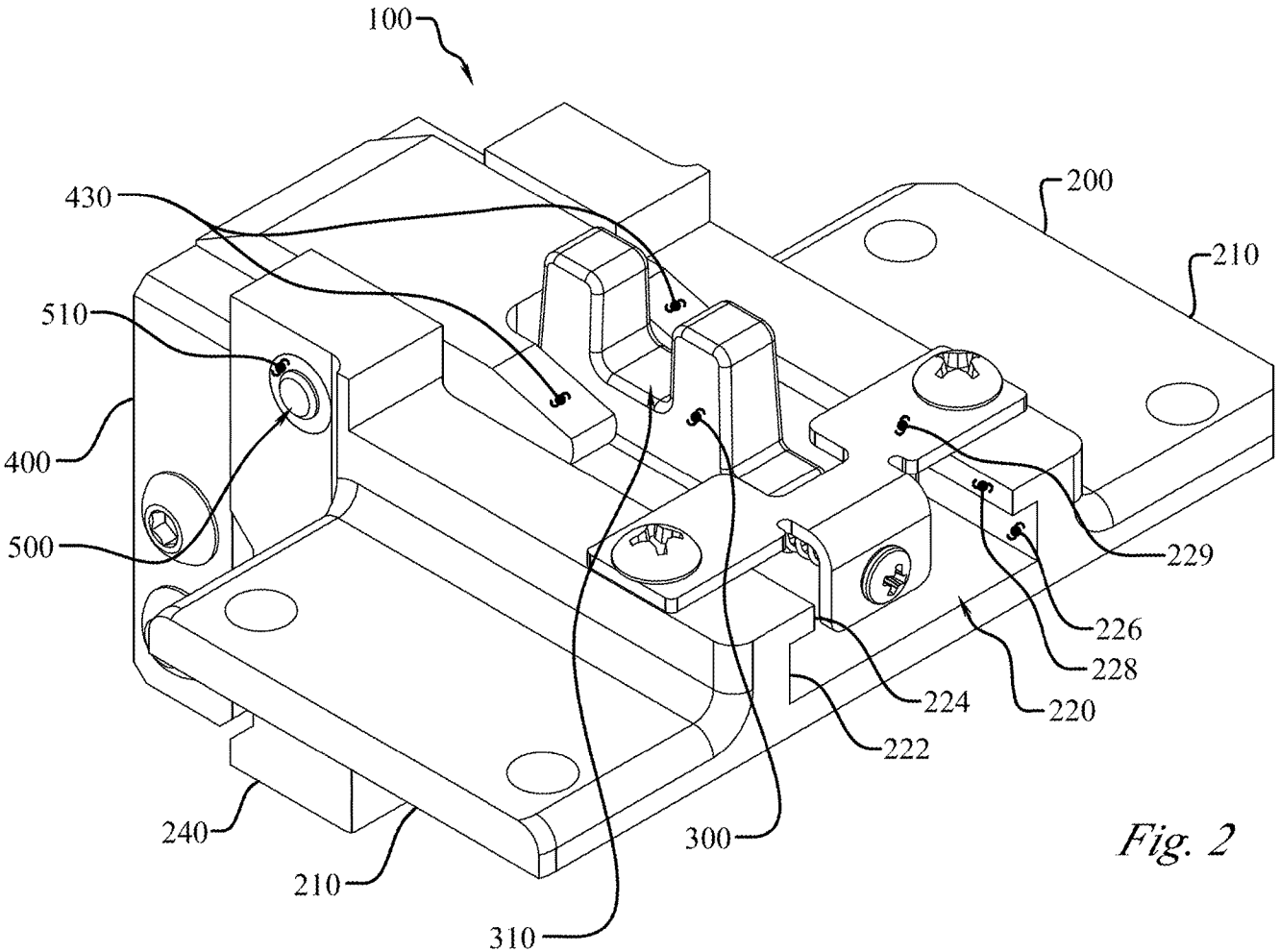
FIG. 2 shows an isometric view of components of an embodiment of an automatic slicer clamp mechanism.
Figure 3:
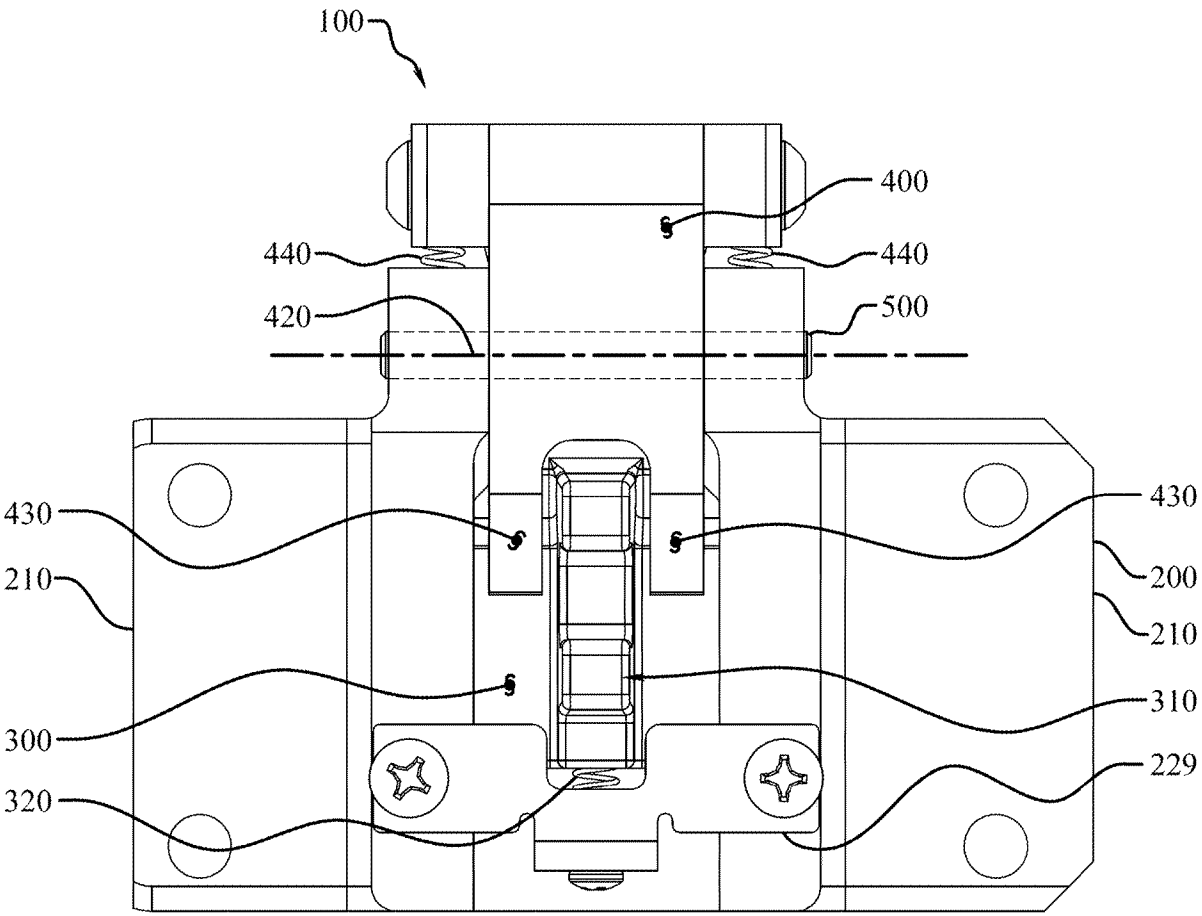
FIG. 3 shows a top plan view of an embodiment of an automatic slicer clamp mechanism.
Figure 4:
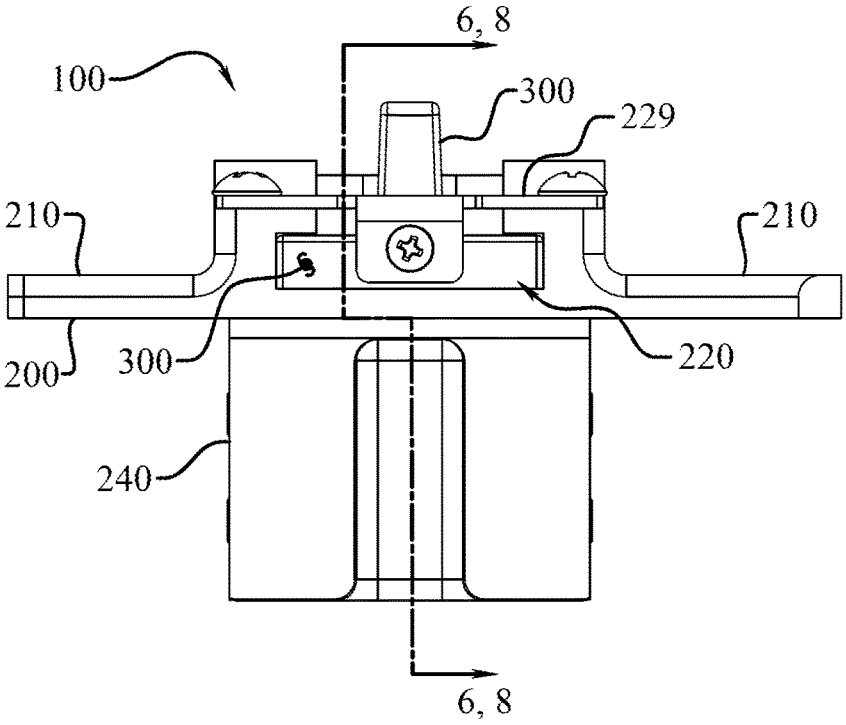
FIG. 4 shows a rear elevation view of an embodiment of an automatic slicer clamp mechanism.

These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The present invention enables a significant advance in the state of the art. The preferred embodiments of the invention accomplish this by new and novel arrangements of elements, materials, relationships, and methods that are configured in unique and novel ways and which demonstrate previously unavailable but preferred and desirable capabilities. The description set forth below in connection with the drawings is intended merely as a description of the presently preferred embodiments of the invention, and is not intended to represent the only form in which the present invention may be constructed or utilized. The description sets forth the designs, materials, functions, means, and methods of implementing the invention in connection with the illustrated embodiments. It is to be understood, however, that the same or equivalent functions, features, and material properties may be accomplished by different embodiments that are also intended to be encompassed within the spirit and scope of the invention. The present disclosure is described with reference to the accompanying drawings with preferred embodiments illustrated and described. The disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout the disclosure and the drawings. In the figures, the thickness of certain lines, layers, components, elements or features may be exaggerated for clarity. The inventive features include all novel and non-obvious features disclosed herein both alone and in novel and non-obvious combinations with other elements. As used herein, the phrase "and/or" means "and", "or" and both "and" and "or". As used herein, the singular forms "a," "an," and "the" refer to one or more than one, unless the context clearly dictates otherwise. As used herein, the term "includes" means "comprises." The preferred embodiments of the invention accomplish the stated objectives by new and novel arrangements of elements and configurations, materials, and methods that are configured in unique and novel ways and which demonstrate previously unavailable but preferred and desirable capabilities.

The present invention enables a significant advance in the state of the art. The preferred embodiments of the invention accomplish this by new and novel arrangements of elements, materials, relationships, and methods that are configured in unique and novel ways and which demonstrate previously unavailable but preferred and desirable capabilities. The description set forth below in connection with the drawings is intended merely as a description of the presently preferred embodiments of the invention, and is not intended to represent the only form in which the present invention may be constructed or utilized. The description sets forth the designs, materials, functions, means, and methods of implementing the invention in connection with the illustrated embodiments. It is to be understood, however, that the same or equivalent functions, features, and material properties may be accomplished by different embodiments that are also intended to be encompassed within the spirit and scope of the invention. The present disclosure is described with reference to the accompanying drawings with preferred embodiments illustrated and described. The disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout the disclosure and the drawings. In the figures, the thickness of certain lines, layers, components, elements or features may be exaggerated for clarity. Broken lines illustrate optional features or operations unless specified otherwise. All publications, patent applications, patents, and other references mentioned herein are incorporated herein by reference in their entireties.

Figure 10:
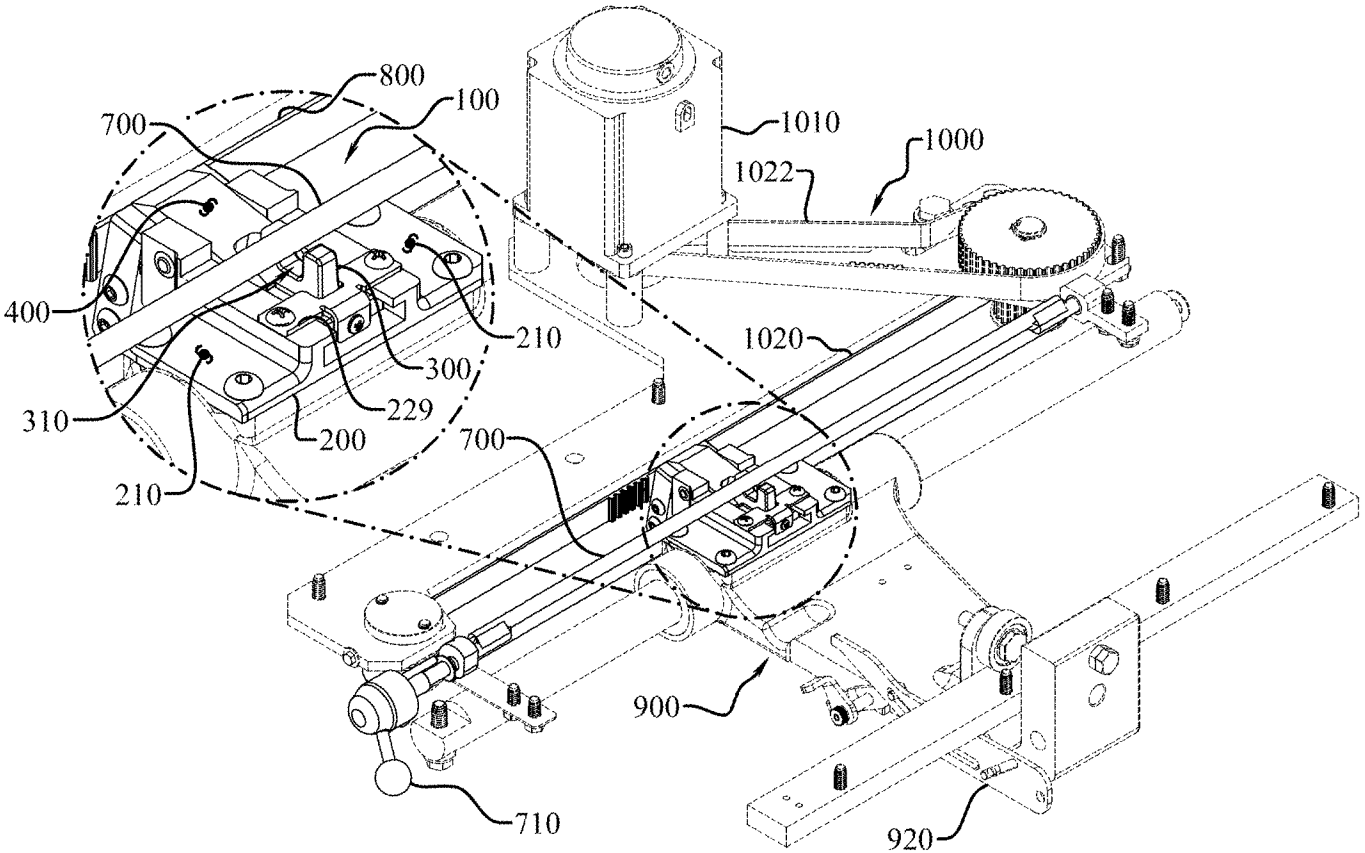
FIG. 10 shows a magnified isometric view of an embodiment of an automatic slicer clamp mechanism.
Figure 15:
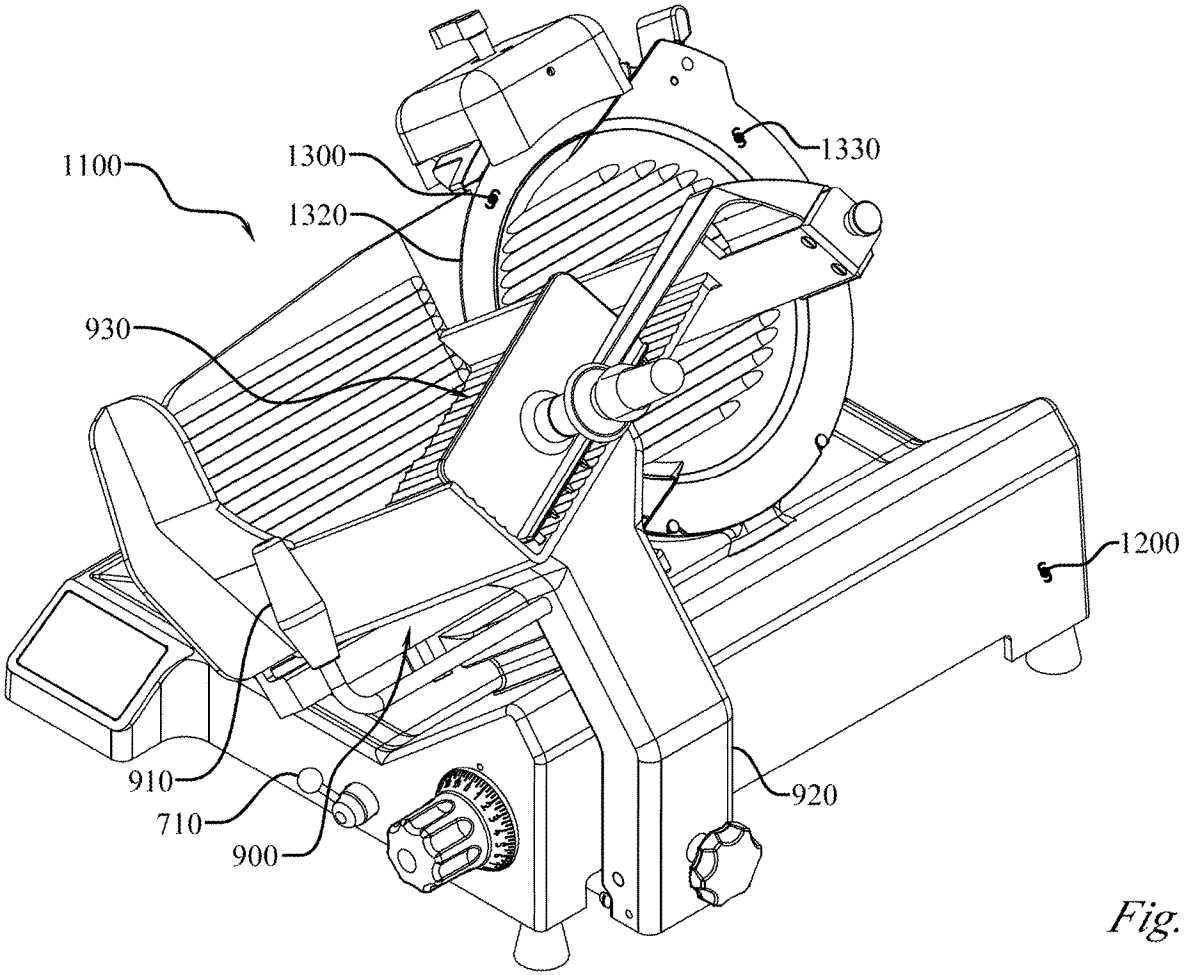
FIG. 15 shows an isometric view of an embodiment of a product slicer.

Embodiments of the present invention relate to a food product slicer (1100), such as the one illustrated in FIG. 15. The product slicer (1100) includes a housing (1200); a knife (1300) mounted to the housing (1200) and rotatable about a central knife axis, the knife (1300) having a knife cutting edge (1320) defining a knife cutting plane, and may include a knife cover (1330); a carriage assembly (900) mounted to the housing (1200), the carriage assembly (900) including a carriage table (930) configured for reciprocating motion past the knife cutting edge (1320); a drive system (1000) mounted to the housing (1200) and including at least one motor (1010) to drive a belt (1020), as illustrated in FIG. 10; and an automatic slicer engagement mechanism (100) attached to the carriage assembly (900) and configured for releasable engagement with the belt (1020). The carriage table (930) is generally connected to a carriage arm (920) that cooperates with other components under, or within, the housing (1200). The drive system (1000) may include several additional belts, such as the secondary belt (1022), illustrated in FIG. 10, to transmit power to the carriage assembly (900) within the space limitations of the housing (1200), which often dictate the location of the motor (1010).

Figure 11:
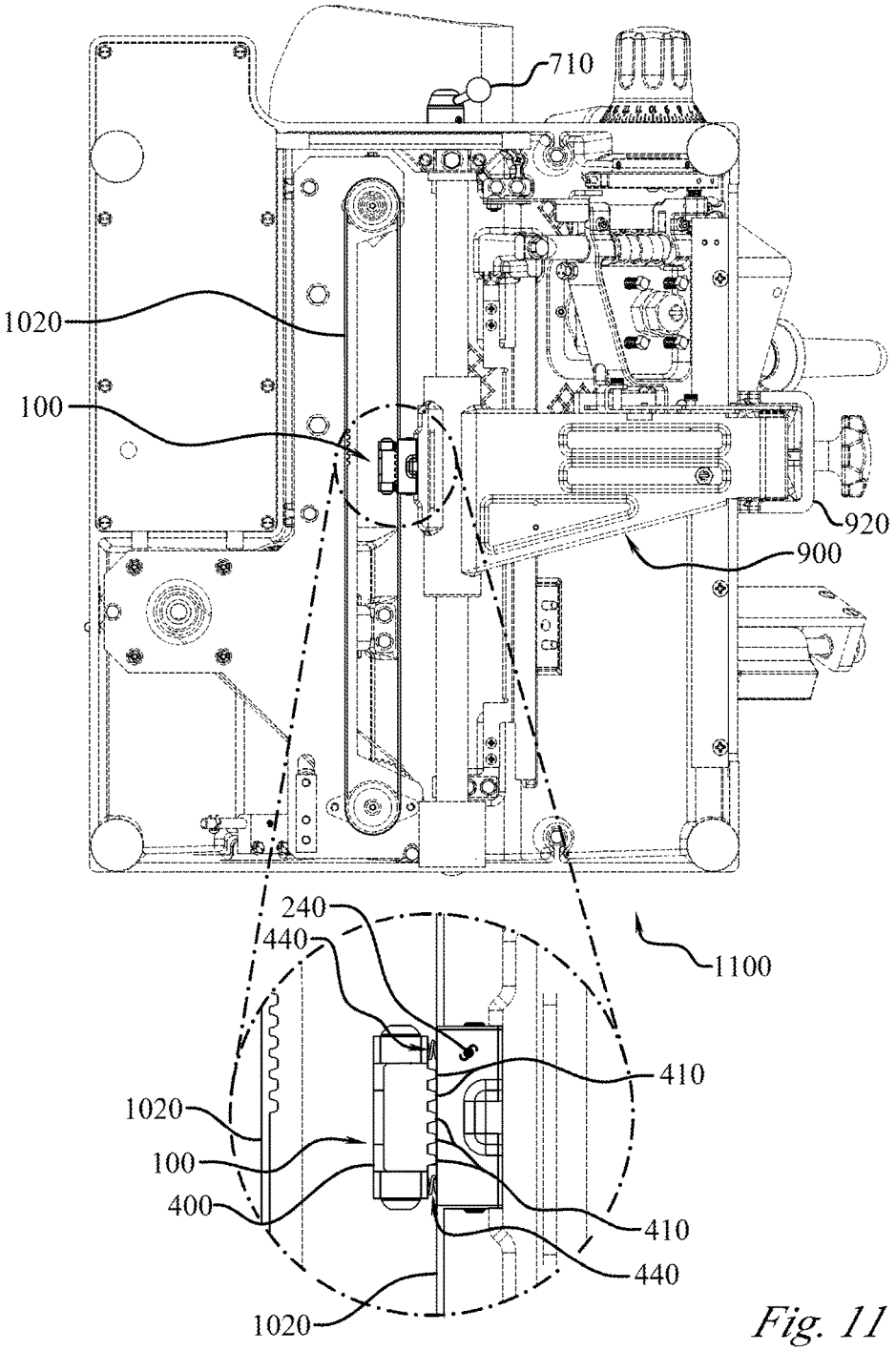
FIG. 11 shows a magnified bottom plan view of an embodiment of an automatic slicer clamp mechanism in an engaged state.
Figure 12:
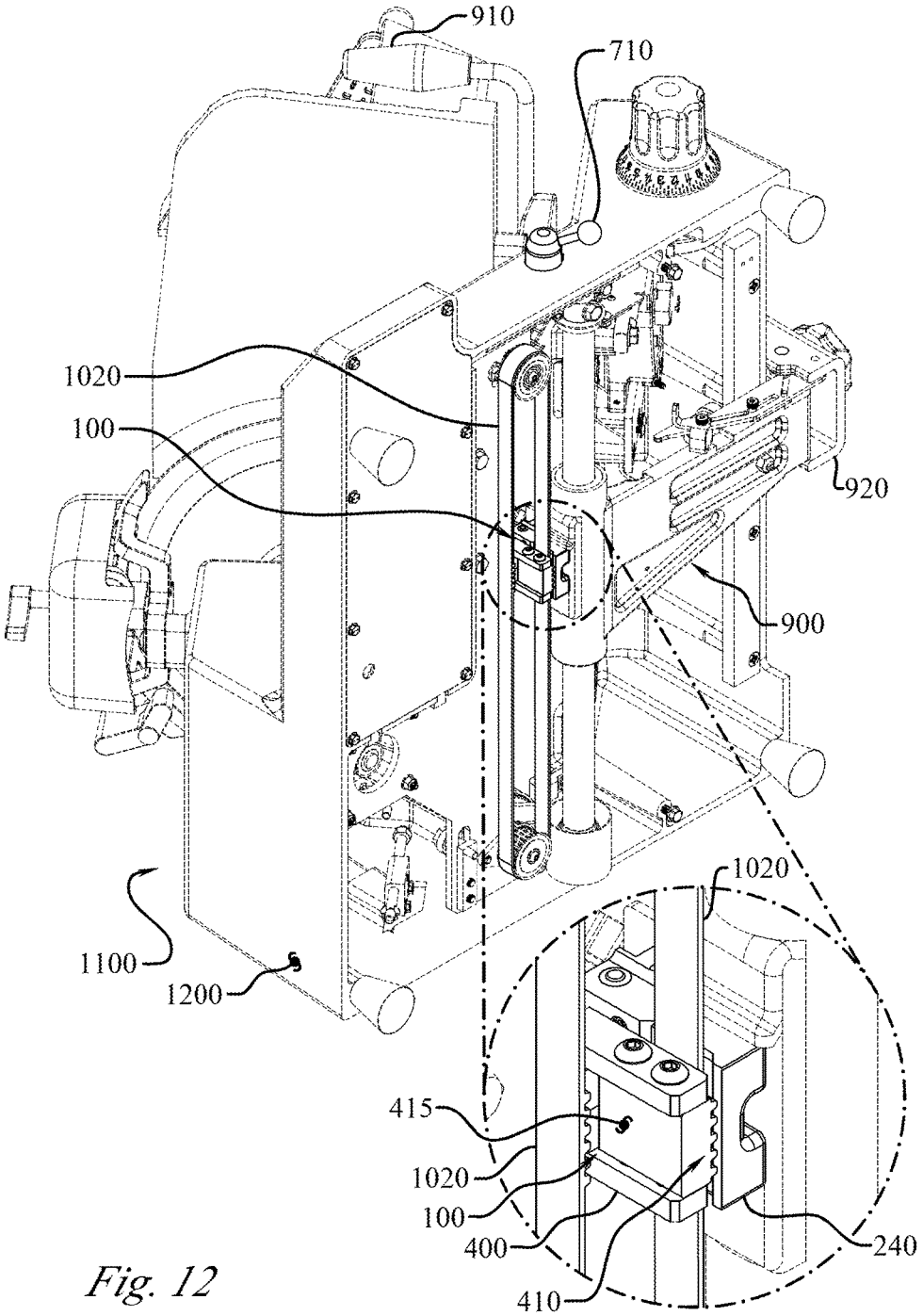
FIG. 12 shows a magnified isometric view of an embodiment of an automatic slicer clamp mechanism in an engaged state.
Figure 13:
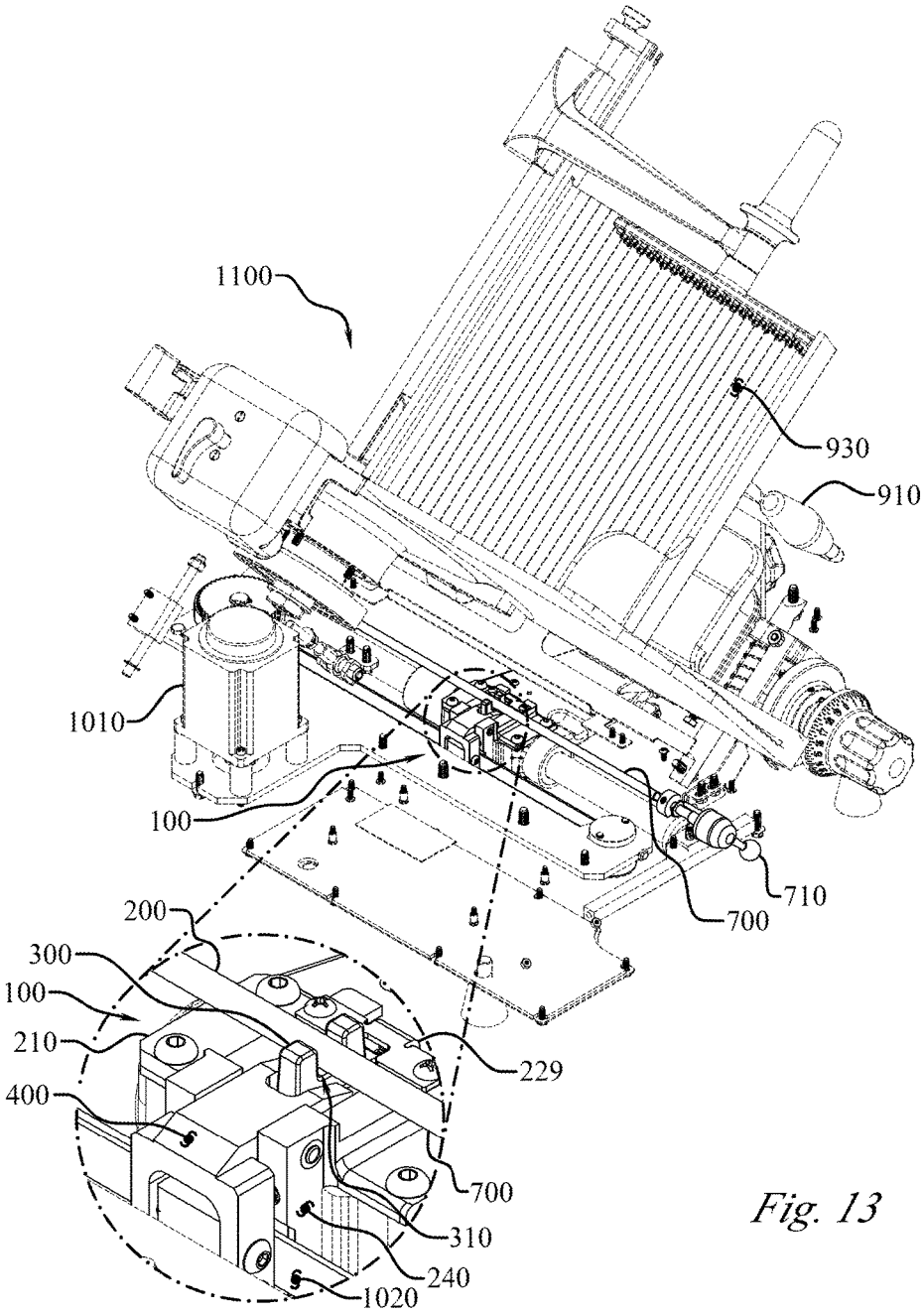
FIG. 13 shows a magnified isometric view of an embodiment of an automatic slicer clamp mechanism in an engaged state.
Figure 14:
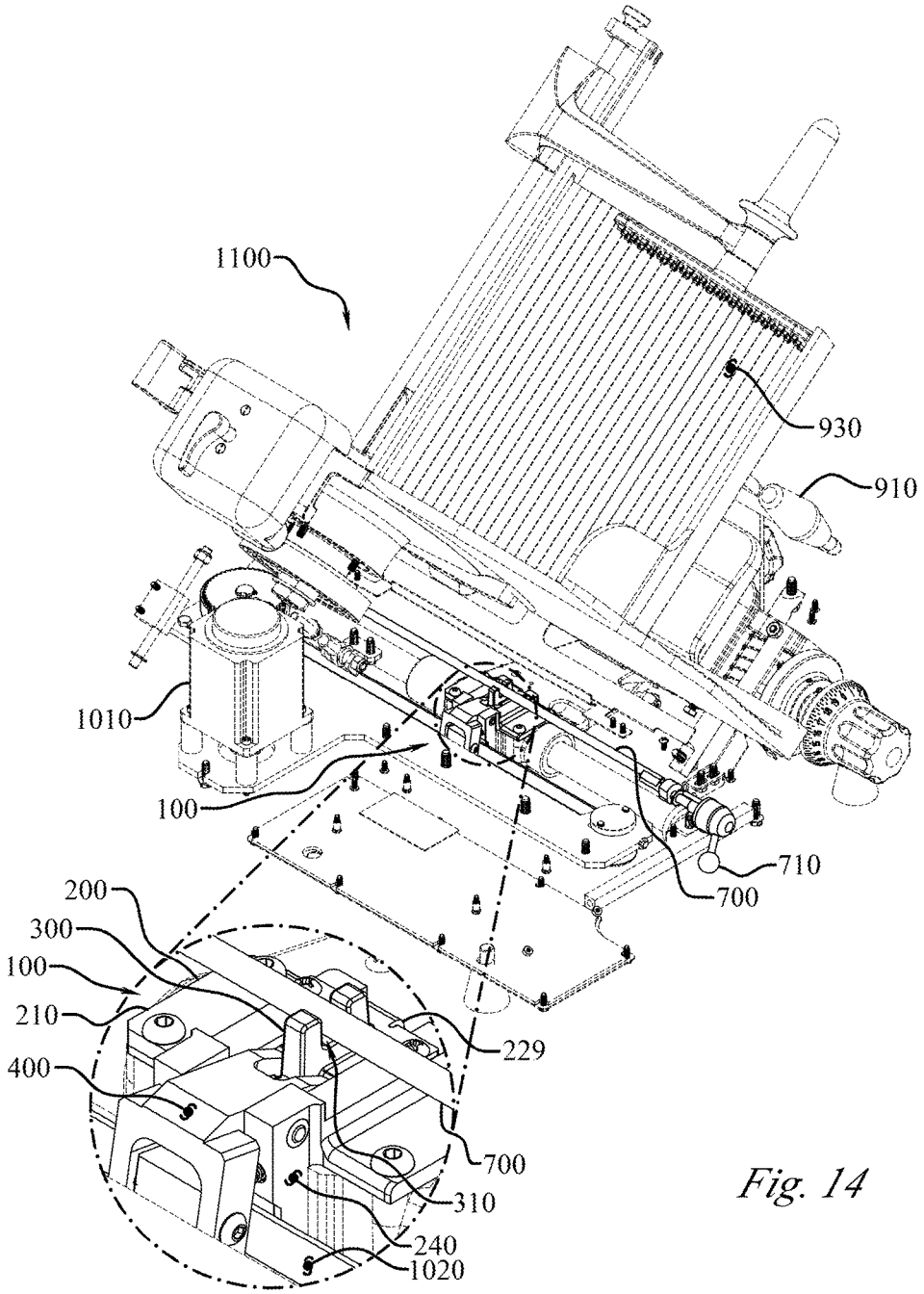
FIG. 14 shows a magnified isometric view of an embodiment of an automatic slicer clamp mechanism in a disengaged state.

The automatic slicer engagement mechanism (100) allows a user of the product slicer (1100) to easily and securely switch back and forth between manual slicing, where the automatic slicer engagement mechanism (100) is disengaged from the belt (1020), as seen in FIGS. 7, 8, 10, and 14, so that the user controls the motion of the carriage assembly (900) back and forth past the cutting edge (1320), and automatic slicing, where the automatic slicer engagement mechanism (100) is securely mated with, or locked to, the belt (1020), as seen in FIGS. 5, 11, 12, and 13, so that movement of the belt (1020), powered by at least one motor (1010), controls the motion of the carriage assembly (900) back and forth past the cutting edge (1320). In one embodiment the engagement and disengagement of the automatic slicer engagement mechanism (100) with the belt (1020) is controlled by an actuator (700) with may be a manually activated device powered by the user, or may be a power activated device that is triggered by the user. For example, FIGS. 10, 13, and 14 illustrate manual embodiments wherein the actuator (700) includes an actuator handle (710), attached to the exterior of the housing (1200), and a rod extending from the actuator handle (710) to the automatic slicer engagement mechanism (100). Movement of the actuator handle (710), either rotationally, as illustrated, or linearly, as would be understood by one skilled in the art, produces movement of the rod, which in turn moves a portion of the automatic slicer engagement mechanism (100) resulting in the engagement or disengagement with the belt (1020). In one such embodiment, seen in FIGS. 10 and 14, the actuator handle (710) is eccentrically connected to the rod, and the rod cooperates with an engagement region (310) of a slide (300), which will be described in great detail later herein, such that rotation of the actuator handle (710) produces movement of the rod, which moves the slide (300) thereby engaging or disengaging the belt (1020). One skilled in the art will appreciate that the actuator (700) may be electrically, pneumatically, or hydraulically powered and activated via a button or switch located on the housing (1200).

Figure 6:
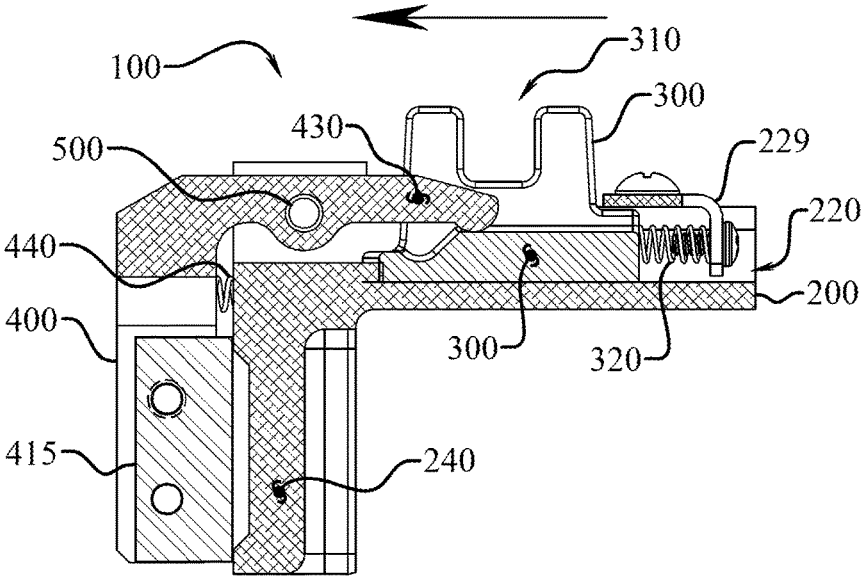
FIG. 6 shows a cross sectional view of an embodiment of an automatic slicer clamp mechanism in an engaged state taken along section line 6-6 in FIG. 4.
Figure 7:
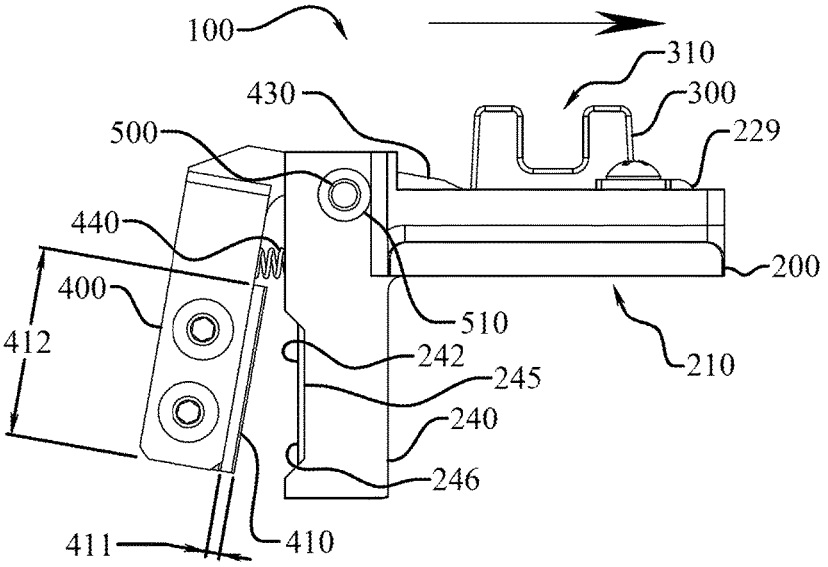
FIG. 7 shows a left side elevation view of an embodiment of an automatic slicer clamp mechanism in a disengaged state.
Figure 8:
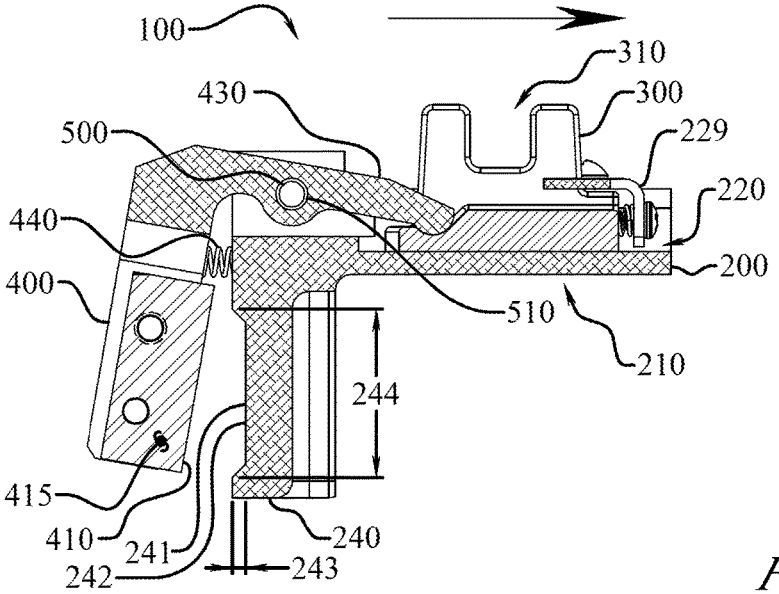
FIG. 8 shows a cross sectional view of an embodiment of an automatic slicer clamp mechanism in a disengaged state taken along section line 8-8 in FIG. 4.

Now, turning the attention to the automatic slicer engagement mechanism (100), an embodiment such as that illustrated in FIGS. 1-9 includes a base (200); a fixed jaw (240)

connected to the base (200) and having a belt engagement surface (241), seen in FIG. 8; a moving jaw (400) connected to the base (200), wherein the moving jaw (400) has at least one jaw tooth (410), seen best in FIGS. 7 and 11, and may incorporate at least one arm (430); and a slide (300) slidably attached to the base (200) and in contact with the at least one arm (430). The slide (300) is configured to move from a first position, shown in FIGS. 7 and 8, to a second position, shown in FIGS. 5 and 6, thereby changing the position of the moving jaw (400) from a disengaged state, seen in FIGS. 7 and 8, to an engaged state, seen in FIGS. 5 and 6.

Figure 24:
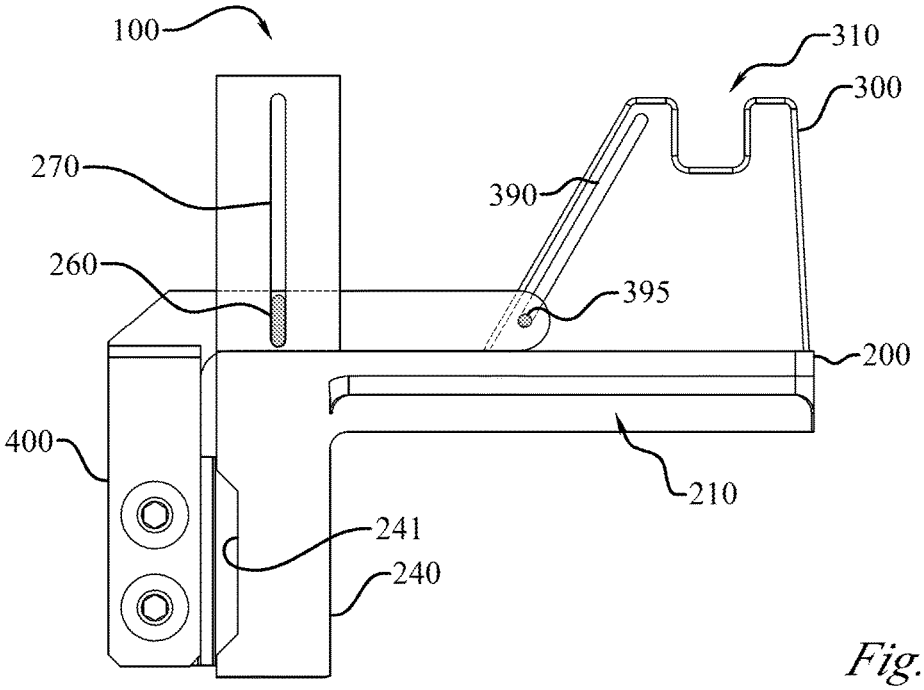
FIG. 24 shows a side elevation view of an embodiment of an automatic slicer clamp mechanism.
Figure 25:
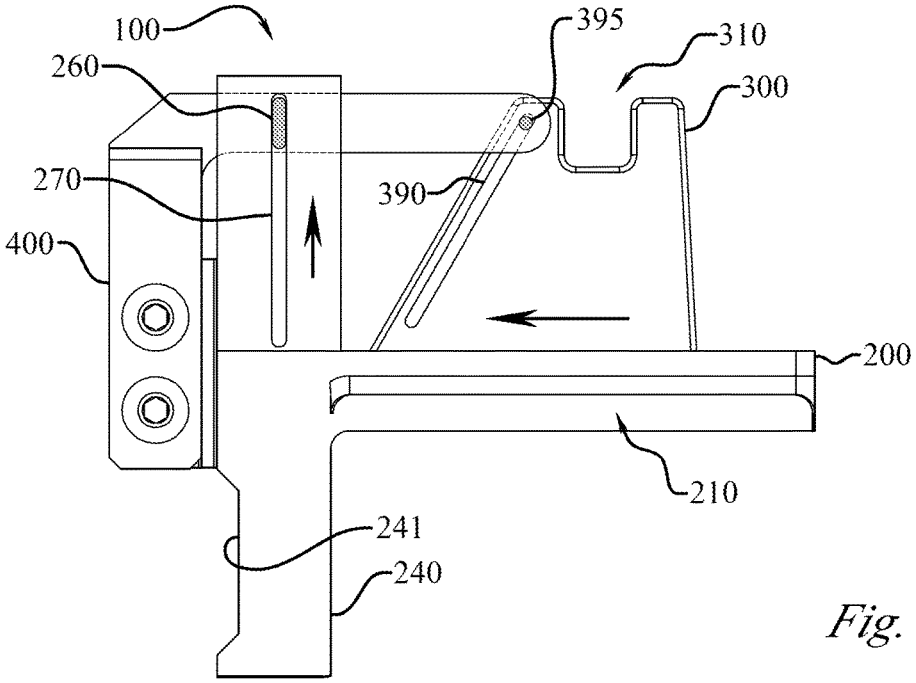
FIG. 25 shows a side elevation view of an embodiment of an automatic slicer clamp mechanism.

In one particular pivoting, or rotating, embodiment the moving jaw (400) is pivotably connected to the base (200) about a pivot axis, seen best in FIGS. 7 and 11, and the at least one arm (430) is located on the opposite side of the pivot axis from the moving jaw (400). In one such embodiment the slide (300) is configured to move from the first position, shown in FIGS. 7 and 8, to the second position, shown in FIGS. 5 and 6, thereby displacing the at least one arm (430) and pivoting the moving jaw (400) from a disengaged state, seen in FIGS. 7 and 8, to an engaged state, seen in FIGS. 5 and 6. In another embodiment the moving jaw (400) is connected to the base (200) to allow linear movement, either horizontally or vertically, of the moving jaw (400) from the disengaged state to an engaged state. One embodiment illustrating horizontal motion of the moving jaw (400) is illustrated in FIGS. 16-23, while an embodiment illustrating vertical motion of the moving jaw (400) is illustrated in FIGS. 24-25, however such linear motion embodiments are not limited to solely horizontal or vertical motion.

In the disengaged state, seen in FIGS. 7, 8, 10, and 14, the fixed jaw (240) and the moving jaw (400) do not engage the belt (1020) and the carriage assembly (900) is manually movable by the user gripping the carriage handle (910), seen in FIG. 15, and moving at least a portion of the carriage assembly (900) back and forth, past the knife cutting edge (1320). In the engaged state, seen in FIGS. 5, 6, 11, 12, and 13, the at least one jaw tooth (410) has moved, and in some embodiments rotated, to be substantially parallel with the belt engagement surface (241), seen in FIG. 5, and the belt (1020) is securely mated with, or locked, between the fixed jaw (240) and the moving jaw (400), as seen in FIGS. 11 and 12, so that powered movement of the belt (1020) produces powered movement of the carriage assembly (900). Obtaining the substantially parallel relationship of the at least one jaw tooth (410) and the belt engagement surface (241) ensures that the load on the belt (1020) is evenly distributed across the width of the belt (1020), thereby reducing high stress areas and increasing the life of the belt (1020).

Figure 5:
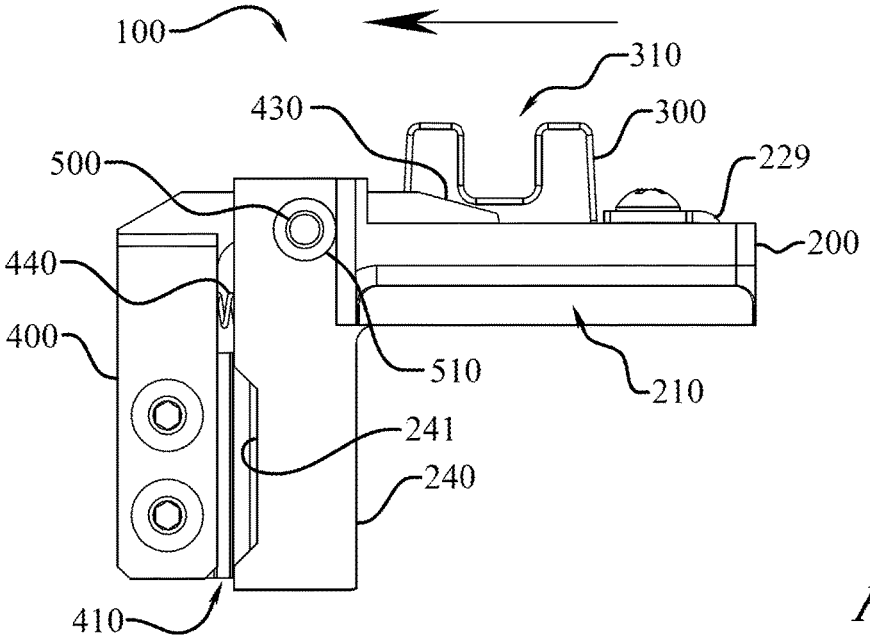
FIG. 5 shows a left side elevation view of an embodiment of an automatic slicer clamp mechanism in the engaged state.

Another embodiment further increases the life of the belt (1020) by incorporating a belt recess (242) in the fixed jaw (240) such that the belt engagement surface (241) is a recess base surface (246) at a recess depth (243), as seen in FIG. 8, and the at least one jaw tooth (410) is configured so that it cannot enter the belt recess (242), as seen in FIGS. 5 and 6. Such embodiments ensure that the moving jaw (400) does not apply a compressive force on the belt (1020), while the parallel relationship ensures that the at least one jaw tooth (410) uniformly engages a belt tooth through the entire belt width. In one embodiment, seen in FIG. 8, the belt recess (242) has a belt recess height (244) and the at least one moving jaw tooth (410) has a tooth height (412) that is greater than the belt recess height (244), preventing entry of the at least one jaw tooth (410) into the belt recess (242), and again ensuring that the at least one jaw tooth (410) is not compressing the body of the belt (1020), and ensuring contact of the at least one jaw tooth (410) and a belt tooth through the entire belt width. In one particular embodiment the belt (1020) has a belt pitch, a belt tooth depth, a belt thickness, and a belt width, as would be understood to one skilled in the art. In an even further embodiment the recess depth (243) is greater than a difference between the belt thickness and the tooth thickness, further ensuring that the at least one jaw tooth (410) does not impart a compressive load on the body of the belt (1020) between the belt teeth. The belt (1020) illustrated in FIGS. 10-12 only shows belt teeth in select areas of the belt (1020), however one skilled in the art will appreciate that the entire length of the belt (1020) may incorporate belt teeth, on one side or both sides. In one embodiment the belt (1020) is a synchronous belt, which is often referred to as a timing belt, toothed belt, cogged belt or cog belt, or a non-slipping mechanical drive belt. In a further embodiment it is a flexible belt with teeth molded onto its inner surface, which in an even further embodiment includes a flexible polymer over a fabric reinforcement, which may include nylon, Kevlar or other aramid fibers and carbon fibers. Still a further embodiment incorporates a recess ingress/egress surface (245), seen in FIG. 7, to guide the belt (1020) into the belt recess (242). The recess ingress/egress surface (245) may be a chamfered surface or a filleted surface to keep the belt (1020) from rubbing against a hard corner of the fixed jaw (240), thereby preventing premature wear of the belt (1020) and extending the life cycle. In one embodiment the at least one jaw tooth (410) has a tooth projection (411), seen in FIG. 7, that is greater than the recess depth (243); and in an even further embodiment the belt tooth depth is greater than the recess depth (243); thereby further improving belt life in an environment that may produce millions of cycles per year.

As previously touched upon, the slide (300) is configured to move from a first position, shown in FIGS. 7 and 8, to a second position, shown in FIGS. 5 and 6, which in some embodiments thereby displaces the at least one arm (430) and pivots the moving jaw (400) from a disengaged state, seen in FIGS. 7 and 8, to an engaged state, seen in FIGS. 5 and 6, while in other embodiments the movement of the slide (300) from the first position to the second position results in the translation, or linear movement (horizontally, vertically, or otherwise), of the moving jaw (400) from the disengaged state to the engaged state as seen in FIGS. 16-25. In one embodiment the linear translation from the first position to the second position is less than 0.375 inches and the rotation of the moving jaw (400) from the disengaged state to the engaged state is less than 30 degrees; while in a further embodiment the linear translation is no more than 0.250 inches and the rotation of the moving jaw (400) is no more than 20 degrees; and in yet another embodiment the linear translation is at least 0.125 inches and the rotation of the moving jaw (400) is at least 5 degrees. In another embodiment, such as the horizontally translating moving jaw (400) embodiments shown in FIGS. 16-23, the linear translation from the first position to the second position is less than 0.375 inches and the translation of the moving jaw (400) from the disengaged state to the engaged state is less than 0.375 inches; while in a further embodiment the linear translation is no more than 0.250 inches and the translation of the moving jaw (400) is no more than 0.250 inches; and in yet another embodiment the linear translation is at least 0.125 inches and the translation of the moving jaw (400) is at least 0.125 inches. In another embodiment, such as the vertically translating moving jaw (400) embodiments shown in FIGS. 24-25, the linear translation from the first position to the second position is less than 0.750 inches and the translation of the moving jaw (400) from the disengaged state to the engaged state is at least 0.500 inches; while in a further embodiment the linear translation is no more than 0.500 inches and the translation of the moving jaw (400) is at least 0.750 inches; and in yet another embodiment the linear translation is at least 0.125 inches and the translation of the moving jaw (400) is at least 1.000 inch. These ranges, combined with the various component configurations described in the embodiments herein, provide unique positive engagement between the automatic slicer engagement mechanism (100) and the belt (1020) providing increased safety and confidence in the engagement, while reducing the likelihood of partial, or temporary, engagement.

After all, one skilled in the art will appreciate that the velocity of the carriage assembly in a powered automated mode is significant and is changing directions very quickly, which when combined with the weight of the moving components and the food product on the carriage table (930) can create a dangerous environment if the automatic slicer engagement mechanism (100) should unintentionally become disengaged from the belt (1020), or should the belt (1020) break, while in motion. In fact, such unintentional disengagement during powered motion is likely to damage the product slicer (1100) and may send components, or product, flying when the carriage assembly (900) abruptly meets the end of its uncontrolled travel. An even more common problem is that of a user grabbing the carriage handle (910) while the product slicer (1100) is in automatic mode, which results in a force being applied to the moving jaw (400) as the belt (1020) continues to move but the automatic slicer engagement mechanism (100) stops, or slows down to a speed that is not in sync with the belt (1020). When this happens the belt teeth serve as a ramp for the teeth of the moving jaw (400) and an opening force is exerted on the moving jaw (400), which in the past systems has often resulted in separation of the jaws enough to disengage a belt and let it pass through the jaws with a tremendous amount of chatter and abuse to the belt, often leading to premature failure, or producing an opening force that is great enough to displace the moving jaw all the way to a disengaged state.

Embodiments of the present invention entirely eliminate this issue by arranging components of the automatic slicer engagement mechanism (100) such that they create a mechanical lock that keeps the moving jaw (400) fixed in the engaged position until it is unlocked, regardless of the opening force exerted on the moving jaw (400) by the belt (1020). For example in the embodiment illustrated in FIGS. 5 and 6 the slide (300) creates a mechanical lock when it is in the second position, meaning no matter the size of the opening force attempting to displace the moving jaw (400), the moving jaw (400) cannot be displaced because the slide (300) is under the at least one arm (430) and prevents it from rotating, and thereby preventing movement of the moving jaw (400). Thus, the mechanical lock may be a portion of one of the components discussed herein, such as the elegant design of FIG. 6 where the slide (300) also performs the function of the mechanical lock, or the mechanical lock may be a separate distinct component that moves into position when the automatic slicer engagement mechanism (100) is in the engaged state and prevents movement of the moving jaw (400), the slide (300), and/or the jaw pivot shaft (500), regardless of the opening force.

Figure 16:
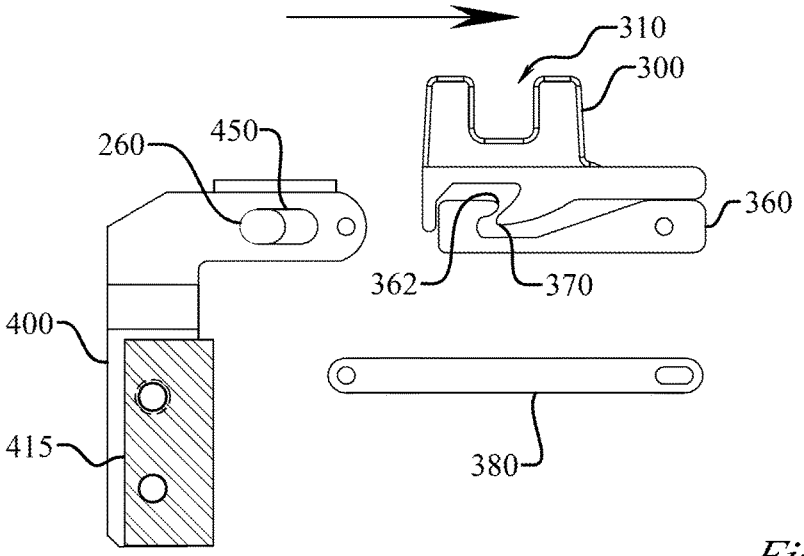
FIG. 16 shows a side elevation view of an embodiment of an automatic slicer clamp mechanism.
Figure 17:
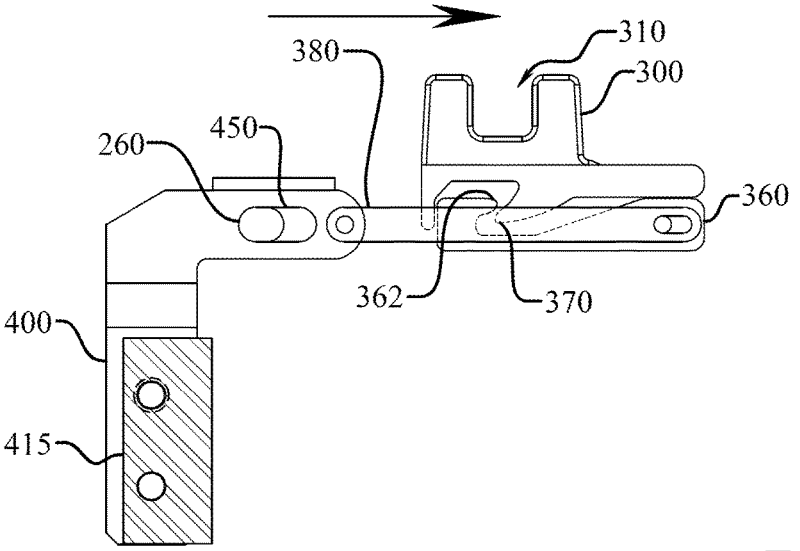
FIG. 17 shows a side elevation view of an embodiment of an automatic slicer clamp mechanism.
Figure 18:
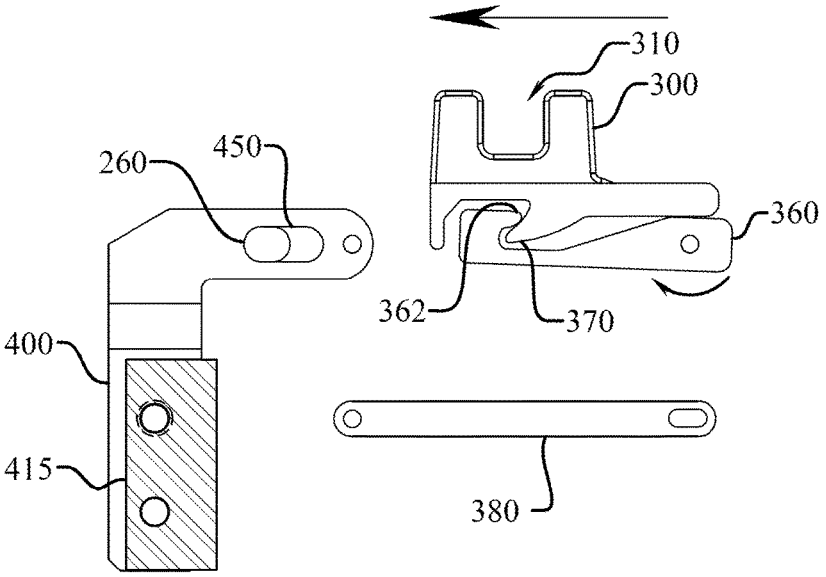
FIG. 18 shows a side elevation view of an embodiment of an automatic slicer clamp mechanism.
Figure 19:
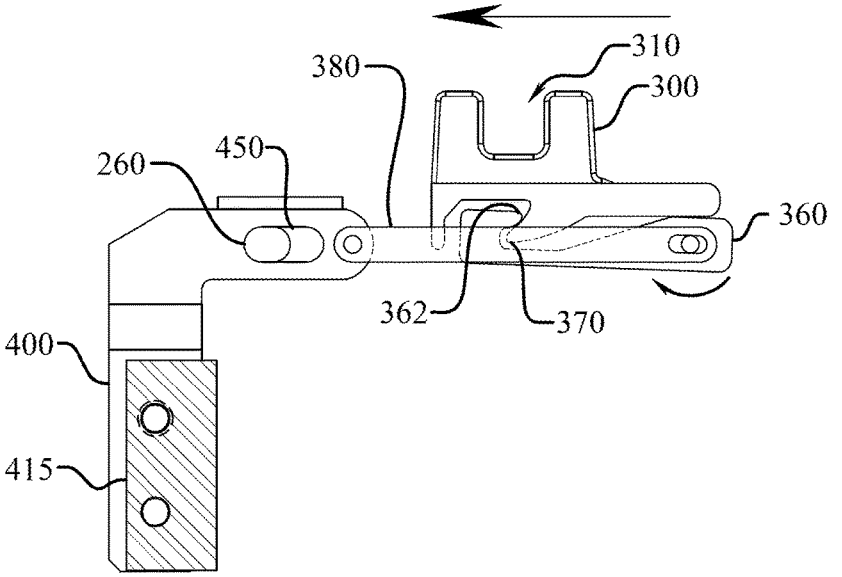
FIG. 19 shows a side elevation view of an embodiment of an automatic slicer clamp mechanism.
Figure 20:
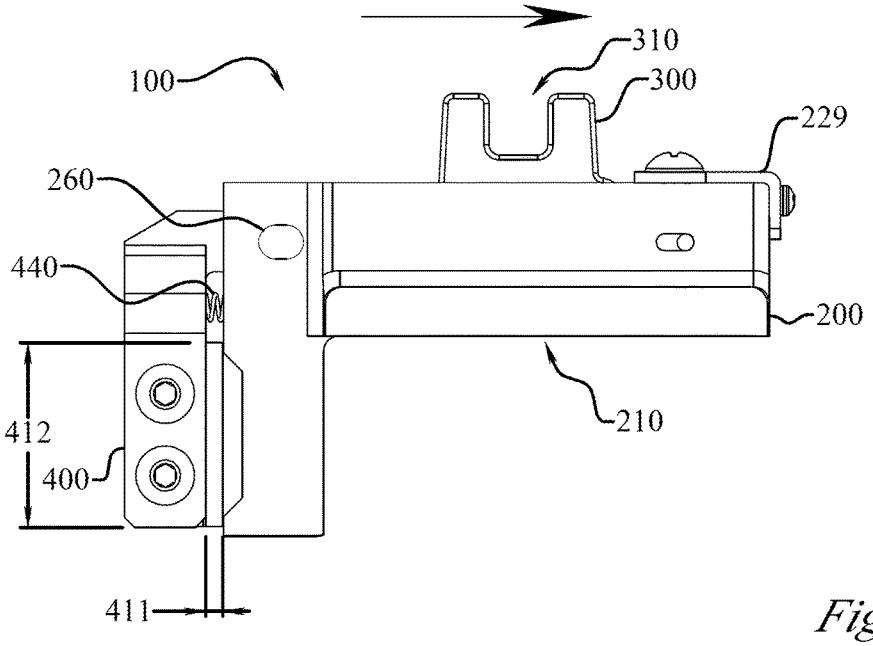
FIG. 20 shows a side elevation view of an embodiment of an automatic slicer clamp mechanism.
Figure 21:
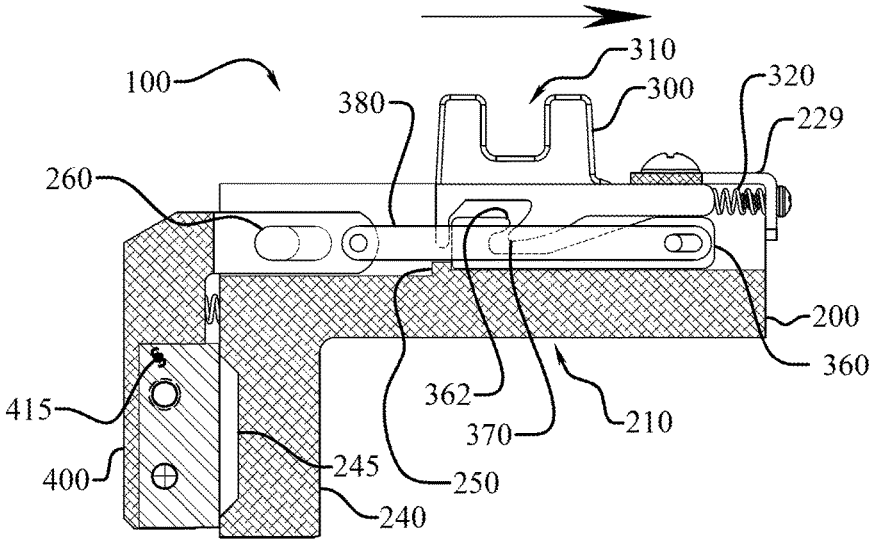
FIG. 21 shows a partial cross-sectional view of an embodiment of an automatic slicer clamp mechanism.
Figure 22:
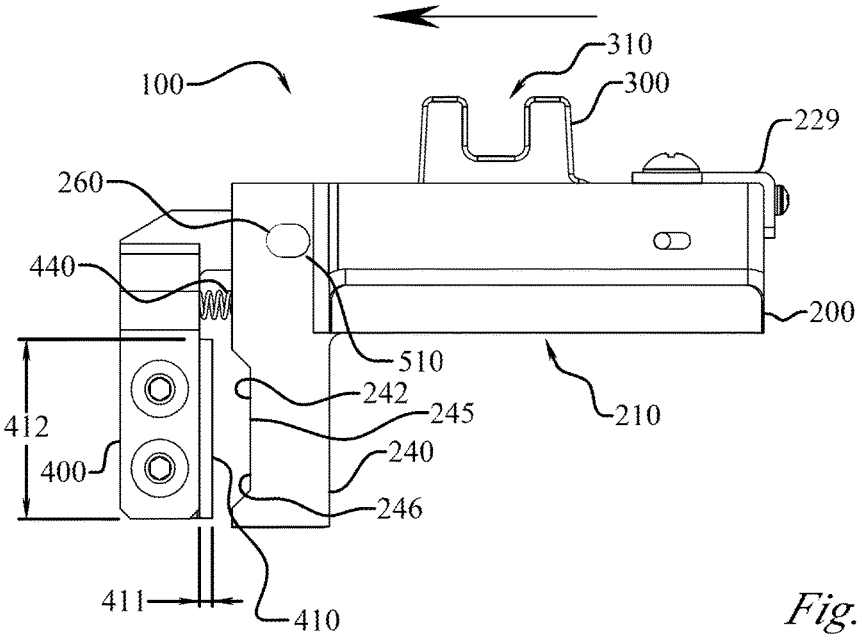
FIG. 22 shows a side elevation view of an embodiment of an automatic slicer clamp mechanism.
Figure 23:
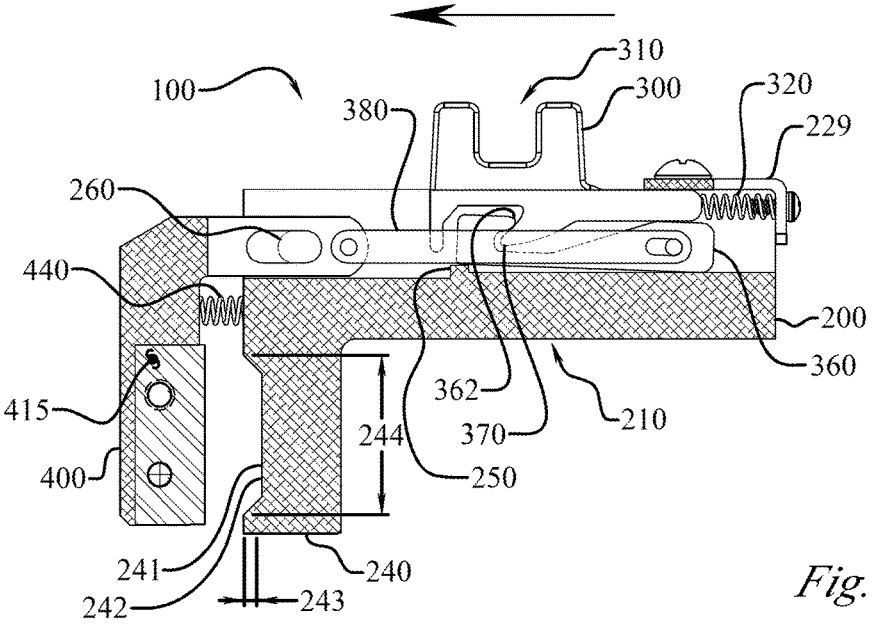
FIG. 23 shows a partial cross-sectional view of an embodiment of an automatic slicer clamp mechanism.

In a horizontally traversing moving jaw (400) embodiment of FIGS. 16-23, the base mechanical lock feature (250), seen best in FIGS. 21 and 23, is a portion of the base (200) that essentially blocks, or limits, the movement of at least a portion of the slide (300) when the automatic slicer engagement mechanism (100) is in the engaged state, such that an opening force cannot move the slide (300). In fact, in this embodiment the slide (300) cannot move past the base mechanical lock feature (250) of the base (200) until it is displaced in a direction different from the normal direction of travel from the first position to the second position. As seen in FIGS. 16 and 17, the slide (300) includes a slide block (360), which is interconnected with the moving jaw (400) via a linkage (380). The slide (300) has a slide tongue (370) configured to cooperate with a block lip (362), or vice versa, and the moving jaw (400) may have a recess (450) that cooperates with the base (200), or a portion of the base (200) such as guide (260), to limit the movement of the moving jaw (400). When the moving jaw (400) is in the engaged state, best seen in FIG. 17, the slide block (360) is blocked by the base mechanical lock feature (250). Thus, an opening force on the moving jaw (400) is not going to separate the jaws (240, 400). Then, movement of the slide (300) results in cooperation of the slide tongue (370) and the block lip (362) to raise the slide block (360) over the base mechanical lock feature (250) and thereby moving the moving jaw (400) to the disengaged state. In a vertically moving jaw (400) embodiment of FIGS. 24-25, the mechanical lock is essentially incorporated into the base (200), or an appurtenance attached to the base (200), and limits the movement of the moving jaw (400) so that it cannot be moved horizontally to separate the jaws (240, 400) no matter the size of the opening force. Here a base recess (270), in cooperation with a guide (260) attached to the moving jaw (400), limits the movement of the moving jaw (400) to the vertical direction, and the slide (300) is formed with a slide recess (390) that cooperates with a slide pin (395) to impart the vertical motion on the moving jaw (400). Thus, as the slide (300) is moved from the position of FIG. 24 to the position of FIG. 25, the slide recess (390) forces the slide pin (395) upward and transmits the motion to the moving jaw (400), whose motion is constrained by the travel of the guide (260) within the base recess (270). In one embodiment the slide recess (390) is at least 15 degrees from the direction of motion of the moving jaw (400), while in a further embodiment it is 20-75 degrees from the direction of motion of the moving jaw (400), while in an even further embodiment it is 25-65 degrees from the direction of motion of the moving jaw (400).

Now embodiments of the automatic slicer engagement mechanism (100) will be disclosed in more detail. First, with reference to FIGS. 1-4, the base (200) may include a mounting flange (210) to aid in securing the automatic slicer engagement mechanism (100) to the carriage assembly (900), as seen best in FIGS. 10 and 12, although one skilled in the art will appreciate that the base (200), or components of the base (200), may actually be formed in the carriage assembly (900). A portion of the base (200) forms the fixed jaw (240), which need not be perpendicular to the mounting flange (210) nor cantilevered from the mounting flange (210) as illustrated in the figures. The moving jaw (400) is configured to cooperate with the fixed jaw (240) and is joined to the base (200) along the pivot axis, which in the illustrated embodiments is defined by at least one pivot shaft aperture (230) in the base (200). In one embodiment the moving jaw (400) is connected to at least one arm (430), which may include a jaw pivot (420) configured to align with the at least one pivot shaft aperture (230) so that the disclosed rotation and relative orientation of the fixed jaw (240) and the moving jaw (400) are achieved. A jaw pivot shaft (500) may rotationally interconnect the fixed jaw (240)

and the moving jaw (400) by passing through the at least one pivot shaft aperture (230) and the jaw pivot (420). The embodiment of FIG. 1 illustrates two pivot shaft apertures (230) that constrain a single jaw pivot (420), having the jaw pivot shaft (500) passing through the two pivot shaft apertures (230) and the single jaw pivot (420) with a shaft retainer (510) at each end of the jaw pivot shaft (500), which may also serve as a low friction bushing.

An embodiment of the automatic slicer engagement mechanism (100) has the moving jaw (400) is biased toward the disengaged state. As one skilled in the art will appreciate, such biasing of the pivoting moving jaw (400) may be accomplished in a number of fashions, including the illustrated embodiment which includes at least one jaw bias device (440) that is compressed between the fixed jaw (240) and the moving jaw (400) to achieve the desired bias. In a further embodiment smooth rotation is ensured by incorporating an even number of one jaw bias devices (440) evenly distributed on opposite sides of the jaw pivot (420).

The base (200) may be formed, integrally or by the assembly of separate components, to include a track in which the slide (300) moves. In the illustrated embodiments this track is labeled as a slide retaining region (220). As seen best in FIG. 2, the slide retaining region (220) may include a dextral sidewall (222) and a sinistral sidewall (226) to constrain lateral movement of the slide (300), and may include a dextral ledge (224) and a sinistral ledge (228) to constrain movement that is not parallel to the designed direction of motion of the slide (300). Further, the movement of the slide (300) may be further constrained by an auxiliary stop (229), to prevent the slide (300) from exiting an open end of the slide retaining region (220). Any of the sidewalls (222, 226), ledges (224, 228), or the auxiliary stop (229) may be removable to accommodate the ingress and egress of the slide (300) from the slide retaining region (220).

Now returning to the slide (300) illustrated in FIG. 1. The slide (300) may include an engagement region (310) designed to cooperate with the actuator (700), which controls the position of the slide (300). The actuator (700) applies an engagement force and a disengagement force to the slide (300), wherein the engagement force is the force that must be applied to the slide (300) to move the slide (300) from the first position to the second position and displace the at least one arm (430), as seen in FIGS. 5 and 6, and the disengagement force is the force that must be applied to the slide (300) to move the slide from the second position to the first position, as seen in FIGS. 7 and 8. In one particular embodiment the slide (300) and the at least one arm (430) are configured to require the engagement force to be greater than the disengagement force; while in an even further embodiment the engagement force is at least twice the disengagement force.

The slide engagement region (310) is configured to receive both of these forces from the actuator (700) and convert them into the desired movement of the moving jaw (400). In the embodiment seen in FIGS. 10 and 13, movement of the actuator handle (710) produces movement of the rod, which in turn cooperates with the slide engagement region (310) and thereby applies the engagement and disengagement forces on the slide (300), which then exerts a slide longitudinal engagement force and a slide longitudinal disengagement force to the at least one arm (430). In one specific embodiment, in a cross-section taken perpendicular to the longitudinal axis of the rod, when the slide (300) is in the first position majority of the rod is outside of the engagement region (310), as seen in FIG. 10, whereas in the second position majority of the rod is within the engagement region (310), as seen in FIG. 13. In one particular embodiment the arrangement of components and their attributes requires the slide longitudinal engagement force required to move the slide (300) from the first position to the second position, and thereby place the automatic slicer engagement mechanism (100) in the engaged state, is at least twice the slide longitudinal disengagement force required to move the slide (300) from the second position to the first position, and thereby return the automatic slicer engagement mechanism (100) from the engaged state to the disengaged state.

In one embodiment the slide (300) is biased toward the jaw pivot (420) to encourage smooth and repeatable movement of the slide (300). As one skilled in the art will appreciate, such biasing of the slide (300) may be accomplished in a number of fashions, including the illustrated embodiment which includes at least one slide bias device (320) compressed between the slide (300) and a portion of the base (200), in this case the auxiliary stop (229), to achieve the desired bias. In one particular embodiment a first bias force exerted on the moving jaw (400) by the jaw bias device (440) is greater than a second bias force exerted on the slide (300) by the slide bias device (320), in fact in a further embodiment the first bias force is at least twice the second bias force. As previously mentioned, the actuator (700) need not consist of a mechanical link extending from the exterior of the product slider (1100) to the automatic slicer engagement mechanism (100), rather one skilled in the art will appreciate that the actuator (700) may be electrically, pneumatically, or hydraulically powered and activated via a button or switch located on the housing (1200) to apply the described forces on the slide (300).

In one embodiment the slide (300) is formed with a slide sinistral ledge and a slide dextral ledge, separated by a centrally located engagement region (310). The ledges cooperate with dextral ledge (224) and the sinistral ledge (228) of the slide (300) to retain the slide (300) within the slide retaining region (220). In another embodiment the at least one arm (430) is formed with a recess thereby creating two arms (430) and allowing a portion of the slide (300) to travel into the recess; while in an even further embodiment a portion of the slide (300) is between the two arms (430) in both the second position and the first position. Such symmetrical configurations with the centrally located engagement region (310) provides improved load distribution within the slide (300) as the engagement and disengagement forces are applied to the engagement region, as the slide (300) engages the arms (430) with the slide longitudinal engagement force and the slide longitudinal disengagement force, and as the arms (430) cause the moving jaw (400) to rotate about the jaw pivot (420).

Figure 9A:
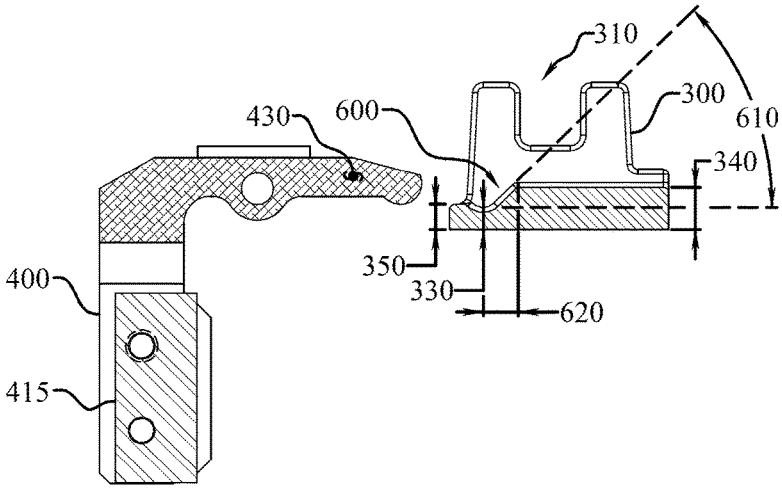
FIG. 9*a* shows a cross sectional view of an embodiment of a clamping jaw and a clamp slide.

In still a further embodiment, as illustrated in FIG. 9*a*, the slide (300) may include an actuating surface (600) to transition from a first slide thickness (330) to a second slide thickness (340), and wherein in the first position, illustrated best in FIG. 8, a portion of the at least one arm (430) is adjacent the first slide thickness (330) until the actuator (700) applies the engagement force causing the slide (300) to move relative to the at least one arm (430) resulting in the actuating surface (600) traversing a portion of the at least one arm (430) to the second position, illustrated best in FIG. 6, wherein a portion of the at least one arm (430) is adjacent the second slide thickness (340). Referring again to FIG. 9*a*, in this embodiment the second slide thickness (340) is greater than the first slide thickness (330) and produces rotation of moving jaw (400) as the slide (300) moves from the first position to the second position. In an even further embodiment the slide (300) also has a third slide thickness (350), also seen in FIG. 9*a*, that is greater than the first slide thickness (330) and located between the first slide thickness (330) and the end of the slide (300) so that the slide (300) is not unintentionally pulled out from under the arm (430). In still another embodiment location of the auxiliary stop (229) prevents the unintentional retraction of the slide (300) from beneath the arm (430), as illustrated in FIG. 8. In one embodiment the second slide thickness (340) is at least twice the first slide thickness (330), while in a further embodiment the second slide thickness (340) is at least 2.5 times the first slide thickness (330), and in still a further embodiment the second slide thickness (340) is no more than 5.0 times the first slide thickness (330). In one particular embodiment the first slide thickness (330) is preferably at least 2 mm and the second slide thickness (340) is preferably at least 4 mm.

Figure 9B:
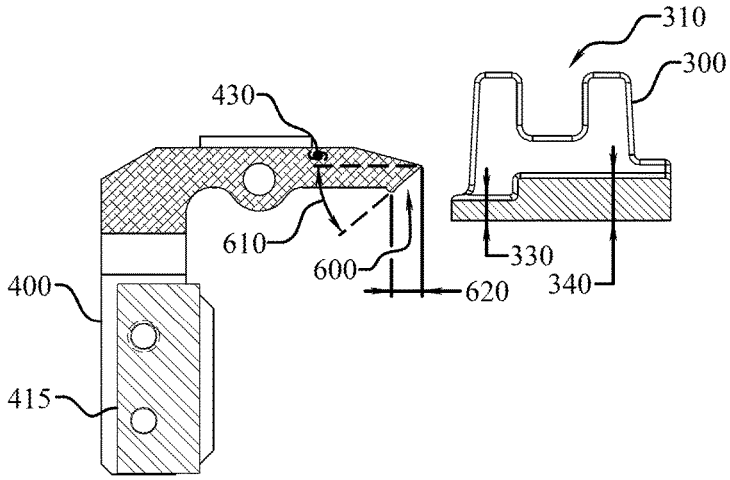
FIG. 9*b* shows a cross sectional view of another embodiment of a clamping jaw and a clamp slide.
Figure 9C:
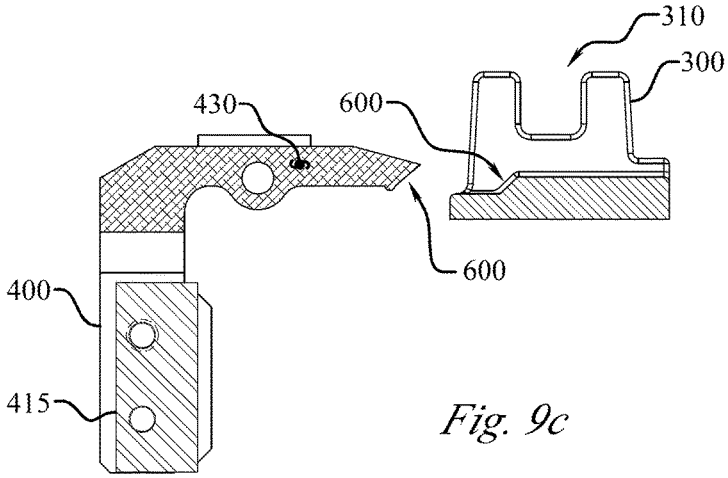
FIG. 9*c* shows a cross sectional view of another embodiment of a clamping jaw and a clamp slide.

The actuating surface (600) allows the slide (300) to smoothly traverse under a portion of the arm (430), yet is not limited to being a part of the slide (300). The actuating surface (600) may be a portion of the arm (430), as seen in FIG. 9*b*, while in an even further embodiment, such as that seen in FIG. 9*c*, the both the arm (430) and the slide (300) incorporate actuating surfaces (600). As seen in FIGS. 9*a* and 9*b*, the actuating surface (600) has an actuating surface angle (610), which is the steepest angle measured on the actuating surface (600) from the longitudinal direction of travel of the slide (300), as well as an actuating surface travel (620) which is the longitudinal distance between the second slide thickness (340) and the first slide thickness (330). In one specific embodiment the actuating surface (600) is oriented at an actuating surface angle (610) that is no more than 60 degrees, while in a further embodiment the actuating surface angle (610) that is no more than 50 degrees, and in still a further embodiment the actuating surface angle (610) that is no more than 40 degrees. However, another series of embodiments recognize that this transition must be somewhat abrupt so the jaw tooth (410), or plurality of jaw teeth, come in contact with the belt teeth the contact is quick and causes the belt to shift slightly if necessary for the jaw teeth to properly engage the belt teeth rather than having the belt stay in place and only afford tip of tooth to tip of tooth contact. Similarly, in another embodiment the actuating surface travel (620) is less than three times the difference between the second slide thickness (340) and the first slide thickness (330), while in a further embodiment it is greater than one times the difference between the second slide thickness (340) and the first slide thickness (330). In one embodiment difference the between the second slide thickness (340) and the first slide thickness (330) is no more than 10 mm, while in another embodiment it is no more than 8 mm, and in yet a further embodiment it is no more than 6 mm. Similarly, in another embodiment the linear translation from the first position to the second position is less than 9.5 mm and the rotation of the moving jaw (400) from the disengaged state to the engaged state is less than 30 degrees.

While some embodiments of the moving jaw (400) have the at least one jaw tooth (410) formed directly in the moving jaw (400), another embodiment incorporates a jaw insert (415) formed to include the at least one jaw tooth (410), as illustrated throughout the figures, that attaches to the moving jaw (400). A removable and interchangeable jaw insert (415) allows a user to easily install a new jaw insert (415) if the teeth break or become worn, or to accommodate a different belt tooth pattern. In still a further embodiment the jaw insert (415) includes at least two teeth patterns on opposing sides of the jaw insert (415), and its attachment to the moving jaw (400) allows a user to easily remove the jaw insert (415), rotate it 180 degrees, and reinstall it to accommodate a different belt tooth pattern.

While the disclosure so far has made reference only to the at least one jaw tooth (410) being associated with the moving jaw (400), one skilled in the art will appreciate that embodiments of the present invention may incorporate the at least one jaw tooth (410) with the fixed jaw (240). Similarly, while the disclosure so far has made reference only to the belt engagement surface (241) and belt recess (242) being associated with the fixed jaw (240), one skilled in the art will appreciate that embodiments may incorporate the belt engagement surface (241) and/or belt recess (242) with the moving jaw (400). Further embodiments incorporate two moving jaws (400) rather than a moving jaw (400) and a fixed jaw (240). In such embodiments all of the disclosed design attributes and embodiments may also be attributed to the second moving jaw (400).

Now, turning the attention to the automatic slicer engagement mechanism (100), an embodiment such as that illustrated in FIGS. 1-9 includes a base (200); a fixed jaw (240) connected to the base (200) and having a belt engagement surface (241), seen in FIG. 8; a moving jaw (400) pivotably connected to the base (200) about a pivot axis, wherein the moving jaw (400) has at least one jaw tooth (410), seen best in FIGS. 7 and 11, and at least one arm (430) located on opposite sides of the pivot axis; and a slide (300) slidably attached to the base (200) and in contact with the at least one arm (430). The slide (300) is configured to move from a first position, shown in FIGS. 7 and 8, to a second position, shown in FIGS. 5 and 6, thereby displacing the at least one arm (430) and pivoting the moving jaw (400) from a disengaged state, seen in FIGS. 7 and 8, to an engaged state, seen in FIGS. 5 and 6.

The slide (300) may be formed of non-metallic material, which in another embodiment includes a lubricating agent so that the slide (300) is self-lubricating. In one embodiment the slide (300) has a specific wear rate against steel of less than 10 ($10^{-6}$ $mm^{-3}$/Nm), wherein the specific wear rate was measured at low speed (0.084 m/s) with a contact pressure of 0.624 MPa in a reciprocating motion (total sliding distance: 4.25 km), while in a further embodiment the non-metallic component has a specific wear rate against steel of less than 7 ($10^{-6}$ $mm^{-3}$/Nm), and in an even further embodiment the non-metallic component has a specific wear rate against steel of less than 4 ($10^{-6}$ $mm^{-3}$/Nm). In another embodiment the non-metallic component material has a dynamic coefficient of friction against steel is less than 0.50, wherein the coefficient of friction was measured at a high speed (0.5 m/s) with a load of 10 N in a sliding motion (Block-on-Ring), while in a further embodiment the dynamic coefficient of friction against steel is less than 0.40, and less than 0.30 in an even further embodiment. While in a further embodiment the slide (300) incorporates a plurality of bearings at the contact surface with the base (200), and an even further embodiment incorporates a roller-rocker type configuration at the contact point between the at least one arm (430) and the slide (300).

In one embodiment the slide (300) is an engineering thermoplastic. In another embodiment the slide (300) is composed primarily of a material selected from polyoxymethylene (POM), poly(methyl methacrylate) (PMMA), acrylonitrile butadiene styrene (ABS), polyamide, polylactic acid (polylactide), polybenzimidazole (PBI), polycarbonate (PC), polyether sulfone (PES), polyether ether ketone (PEEK), polyetherimide (PEI), polyethylene (polyethene, polythene, PE), polyphenylene oxide (PPO), polyphenylene sulfide (PPS), polypropylene (PP), polystyrene, polyvinyl chloride (PVC), polybutylene terephthalates (PBT), thermoplastic polyurethane (TPU), and semi-crystalline engineering resin systems that meet the claimed mechanical properties. In one embodiment the non-metallic material is a polyoxymethylene (POM) homopolymer, which in a further embodiment is an acetal resin. Further, the slide (300) material may be fiber reinforced. In one such embodiment the slide (300) material includes at least 5% fiber reinforcement. In one such embodiment the fiber reinforcement includes long-glass fibers having a length of at least 10 millimeters pre-molding and produce a finished component having fiber lengths of at least 3 millimeters, while another embodiment includes fiber reinforcement having short-glass fibers with a length of at least 0.5-2.0 millimeters pre-molding. Incorporation of the fiber reinforcement increases the tensile strength of the component, however it may also reduce the strain at break therefore a careful balance must be struck to maintain sufficient elongation and ensure durability of the non-metallic component. Therefore, one embodiment includes less than 50% fiber reinforcement, while in an even further embodiment has 5-40% fiber reinforcement, and yet another embodiment has 10-30% fiber reinforcement. Long fiber reinforced non-metallic materials, and the resulting melt properties, produce a more isotropic material than that of short fiber reinforced non-metallic materials, primarily due to the three-dimensional network formed by the long fibers developed during injection molding. Another advantage of long-fiber material is the almost linear behavior through to fracture resulting in less deformation at higher stresses.

In still a further embodiment the non-metallic component is formed of a non-metallic material having a non-metallic material density of less than 2 grams per cubic centimeter and a tensile modulus of at least 4500 MPa (ISO 527-1/-2 test standard); while in a further embodiment the non-metallic material density of less than 1.5 grams per cubic centimeter and a tensile modulus of at least 5000 MPa (ISO 527-1/-2 test standard). In yet a further embodiment the non-metallic material has a non-metallic material tensile strength of at least 85 megapascal (ISO 527-1/-2 test standard), and a non-metallic material strain at break of at least 3.0% (ISO 527-1/-2 test standard); while in an even further embodiment the non-metallic material tensile strength of at least 90 megapascal (ISO 527-1/-2 test standard), and a non-metallic material strain at break of at least 4.0% (ISO 527-1/-2 test standard). In yet a further embodiment the non-metallic component tensile modulus is at least 2 percent of tensile modulus of the at least one arm (430) and the arm (430) material density is at least 3 times the non-metallic material density. In an even further embodiment a strain ratio of the arm (430) material strain at break to the non-metallic material strain at break is less than 25, while in an even further embodiment the strain ratio is less than 20. Conventional thinking would be to make the non-metallic component as strong as possible, which leads to a part formed of material having a high ultimate tensile strength, but one that is generally plagued by a strain at break of 2.5% or less, leading to a large strain ratio and resulting in durability issues. Focusing on unique strain relationships, rather than simply ultimate tensile strength, provide enhanced durability. Such a multi-material interface possessing these unique relationships among the materials achieves the desired durability and wear control, while promoting smooth operation of the interface.

The invention may include any of the embodiments, including any, or all, of the features, disclosed in U.S. patent application Ser. Nos. 15/042,172 and 15/187,851, all of which are incorporated herein by reference.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A product slicer (1100), comprising: a housing (1200); a knife (1300) mounted to the housing (1200) and rotatable about a central knife axis, the knife (1300) having a knife cutting edge (1320) defining a knife cutting plane;

a carriage assembly (900) mounted to the housing (1200), the carriage assembly (900) including a carriage table (930) configured for reciprocating motion past the knife cutting edge (1320);

a drive system (1000) mounted to the housing (1200) and including at least one motor (1010) to drive a belt (1020);

an automatic slicer engagement mechanism (100) attached to the carriage assembly (900) and configured for releasable engagement with the belt (1020), wherein the automatic slicer engagement mechanism (100) includes:

(a) a base (200);

(b) a fixed jaw (240) connected to the base (200) and having a belt engagement surface (241), wherein the fixed jaw (240) includes a belt recess (242) such that the belt engagement surface (241) is a recess base surface (246) at a recess depth (243), and at least one moving jaw tooth (410) is configured so that it cannot enter the belt recess (242);

(c) a moving jaw (400) movably connected to the base (200), wherein the moving jaw (400) comprises the at least one moving jaw tooth (410) and at least one arm (430); and (d) a slide (300) in slidable cooperation with the base (200) and in cooperating with the at least one arm (430), wherein the slide (300) is configured to move from a first position to a second position thereby displacing the at least one arm (430) and the moving jaw (400) from a disengaged state to an engaged state, wherein in the disengaged state the fixed jaw (240) and the moving jaw (400) do not engage the belt (1020) and the carriage assembly is manually movable, and in the engaged state the at least one moving jaw tooth (410) is substantially parallel with the belt engagement surface (241) and the belt (1020) is securely engaged between the fixed jaw (240) and the moving jaw (400) so that powered movement of the belt (1020) produces powered movement of the carriage assembly (900).

2. The product slicer (1100) of claim 1, wherein the slide (300) includes an actuating surface (600) to transition from a first slide thickness (330) to a second slide thickness (340), and wherein in the first position a portion of the at least one arm (430) is adjacent the first slide thickness (330) until an actuator (700) applies an engagement force causing the slide (300) to move relative to the at least one arm (430) resulting in the actuating surface (600) traversing a portion of the at least one arm (430) to the second position wherein a portion of the at least one arm (430) is adjacent the second slide thickness (340), and wherein the second slide thickness (340) is greater than the first slide thickness (330) and produces movement of moving jaw (400) as the slide (300) moves from the first position to the second position.

3. The product slicer (1100) of claim 2, wherein the actuating surface (600) is oriented at an actuating surface angle (610) that is no more than 60 degrees.

4. The product slicer (1100) of claim 1, wherein the moving jaw (400) is biased toward the disengaged state.

5. The product slicer (1100) of claim 4, wherein the slide (300) is biased toward the second position.

6. The product slicer (1100) of claim 1, wherein the linear translation from the first position to the second position is less than 9.5 mm and causes less than 30 degrees of rotation of the moving jaw (400) from the disengaged state to the engaged state.

7. The product slicer (1100) of claim 1, wherein the belt recess (242) has a belt recess height (244) and the at least one moving jaw tooth (410) has a tooth height (412) that is greater than the belt recess height (244), preventing entry of the at least one moving jaw tooth (410) into the belt recess (242).

8. The product slicer (1100) of claim 6, wherein the actuator (700) includes an actuator handle (710), attached to the exterior of the housing (1200), and a rod extending from the actuator handle (710) to the automatic slicer engagement mechanism (100).

9. The product slicer (1100) of claim 8, wherein the actuator handle (710) is eccentrically connected to the rod, and the rod cooperates with an engagement region (310) of the slide (300) such that rotation of the actuator handle (710) produces movement of the rod, which moves the slide (300) from the first position to the second position.

10. A product slicer (1100), comprising: a housing (1200); a knife (1300) mounted to the housing (1200) and rotatable about a central knife axis, the knife (1300) having a knife cutting edge (1320) defining a knife cutting plane; a carriage assembly (900) mounted to the housing (1200), the carriage assembly (900) including a carriage table (930) configured for reciprocating motion past the knife cutting edge (1320); a drive system (1000) mounted to the housing (1200) and including at least one motor (1010) to drive a belt (1020); an automatic slicer engagement mechanism (100) attached to the carriage assembly (900) and configured for releasable engagement with the belt (1020), wherein the automatic slicer engagement mechanism (100) includes: (a) a base (200); (b) a fixed jaw (240) connected to the base (200) and having a belt engagement surface (241); (c) a moving jaw (400) pivotably connected to the base (200) about a pivot axis, wherein the moving jaw (400) has at least one moving jaw tooth (410) and at least one arm (430) located on opposite sides of the pivot axis, and wherein the moving jaw (400) is biased toward the disengaged state; and (d) a slide (300) slidably attached to the base (200) and in contact with the at least one arm (430), wherein the slide (300) is configured to move from a first position to a second position thereby displacing the at least one arm (430) and pivoting the moving jaw (400) from a disengaged state to an engaged state, wherein in the disengaged state the fixed jaw (240) and the moving jaw (400) do not engage the belt (1020) and the carriage assembly is manually movable, and in the engaged state the at least one moving jaw tooth (410) has rotated to be substantially parallel with the belt engagement surface (241) and the belt (1020) is securely engaged between the fixed jaw (240) and the moving jaw (400) so that powered movement of the belt (1020) produces powered movement of the carriage assembly (900); and an actuator (700) that controls the position of the slide (300).

11. The product slicer (1100) of claim 10, wherein the fixed jaw (240) includes a belt recess (242) such that the belt engagement surface (241) is a recess base surface (246) at a recess depth (243), and the at least one moving jaw tooth (410) is configured so that it cannot enter the belt recess (242).

12. The product slicer (1100) of claim 10, wherein the actuator (700) applies an engagement force and a disengagement force to the slide (300), wherein the engagement force is the force that must be applied to the slide (300) to move the slide (300) from the first position to the second position and displace the at least one arm (430), and the disengagement force is the force that must be applied to the slide (300) to move the slide from the second position to the first position, wherein the slide (300) and the at least one arm (430) are configured to require the engagement force to be greater than the disengagement force.

13. The product slicer (1100) of claim 12, wherein the slide (300) includes an actuating surface (600) to transition from a first slide thickness (330) to a second slide thickness (340), and wherein in the first position a portion of the at least one arm (430) is adjacent the first slide thickness (330) until the actuator (700) applies the engagement force causing the slide (300) to move relative to the at least one arm (430) resulting in the actuating surface (600) traversing a portion of the at least one arm (430) to the second position wherein a portion of the at least one arm (430) is adjacent the second slide thickness (340), and wherein the second slide thickness (340) is greater than the first slide thickness (330) and produces rotation of moving jaw (400) as the slide (300) moves from the first position to the second position.

14. The product slicer (1100) of claim 10, wherein the slide (300) is biased toward the second position.

15. The product slicer (1100) of claim 10, wherein the linear translation from the first position to the second position is less than 9.5 mm and the rotation of the moving jaw (400) from the disengaged state to the engaged state is less than 30 degrees.

16. The product slicer (1100) of claim 11, wherein the belt recess (242) has a belt recess height (244) and the at least one moving jaw tooth (410) has a tooth height (412) that is greater than the belt recess height (244), preventing entry of the at least one moving jaw tooth (410) into the belt recess (242).

17. A product slicer (1100), comprising: a housing (1200); a knife (1300) mounted to the housing (1200) and rotatable about a central knife axis, the knife (1300) having a knife cutting edge (1320) defining a knife cutting plane;

a carriage assembly (900) mounted to the housing (1200), the carriage assembly (900) including a carriage table (930) configured for reciprocating motion past the knife cutting edge (1320);

a drive system (1000) mounted to the housing (1200) and including at least one motor (1010) to drive a belt (1020);

an automatic slicer engagement mechanism (100) attached to the carriage assembly (900) and configured for releasable engagement with the belt (1020), wherein the automatic slicer engagement mechanism (100) includes:

(a) a base (200);

(b) a fixed jaw (240) connected to the base (200) and having a belt engagement surface (241);

(c) a moving jaw (400) movably connected to the base (200), wherein the moving jaw (400) comprises the at least one moving jaw tooth (410) and at least one arm (430);

(d) a slide (300) in slidable cooperation with the base (200) and in cooperating with the at least one arm (430), wherein the slide (300) is configured to move from a first position to a second position thereby displacing the at least one arm (430) and the moving jaw (400) from a disengaged state to an engaged state, wherein in the disengaged state the fixed jaw (240) and the moving jaw (400) do not engage the belt (1020) and the carriage assembly is manually movable, and in the engaged state the at least one moving jaw tooth (410) is substantially parallel with the belt engagement surface (241) and the belt (1020) is securely engaged between the fixed jaw (240) and the moving jaw (400) so that powered movement of the belt (1020) produces powered movement of the carriage assembly (900); and (e) a jaw biasing device (440) disposed between the fixed jaw (240) and the moving jaw (400) wherein the jaw biasing device (440) biases the moving jaw (400) to the disengaged state.

18. The product slicer (1100) of claim 17, further comprising a slide biasing device (320) disposed between the slide (300) and a portion of the base (200) wherein the slide biasing device (320) biases the slide (300) to the engaged state.

* * * * *